US006561611B2

(12) United States Patent
Kobayashi et al.

(10) Patent No.: US 6,561,611 B2
(45) Date of Patent: May 13, 2003

(54) DETECTOR UNIT AND INK CARTRIDGE INCORPORATED IN RECORDING APPARATUS, AND METHOD OF JUDGING PRESENCE OF THE INK CARTRIDGE USING THE DETECTOR UNIT

(75) Inventors: Yoichi Kobayashi, Nagano (JP); Kazuhisa Takeda, Nagano (JP); Norihiro Yamashita, Nagano (JP); Mamoru Ukita, Nagano (JP); Kazuo Otsuka, Nagano (JP); Norihiko Kurashima, Nagano (JP)

(73) Assignee: Seiko Epson Corp., Tokyo (JP)

( * ) Notice: Subject to any disclaimer, the term of this patent is extended or adjusted under 35 U.S.C. 154(b) by 0 days.

(21) Appl. No.: 09/730,480

(22) Filed: Dec. 6, 2000

(65) Prior Publication Data

US 2001/0012026 A1 Aug. 9, 2001

(30) Foreign Application Priority Data

| | | |
|---|---|---|
| Dec. 6, 1999 | (JP) | 11-346356 |
| May 31, 2000 | (JP) | 2000-161458 |
| Nov. 2, 2000 | (JP) | 2000-335350 |

(51) Int. Cl.[7] ..... B41J 29/393
(52) U.S. Cl. ..... 347/19; 400/703
(58) Field of Search ..... 347/19, 37, 39, 347/86, 87, 104; 400/283, 703; 271/258.01

(56) References Cited

U.S. PATENT DOCUMENTS

| | | | | |
|---|---|---|---|---|
| 4,709,248 A | | 11/1987 | Piatt et al. | |
| 5,397,192 A | * | 3/1995 | Khormaee | 400/703 |
| 5,627,570 A | * | 5/1997 | Hiramatsu et al. | 347/19 |
| 5,721,581 A | | 2/1998 | Saito et al. | |
| 5,825,381 A | * | 10/1998 | Choo | 347/37 |
| 5,842,800 A | * | 12/1998 | Bailey et al. | 400/703 |
| 6,137,503 A | * | 10/2000 | Hashimoto et al. | 347/19 |
| 6,412,899 B1 | * | 7/2002 | Choo | 347/19 |

FOREIGN PATENT DOCUMENTS

| | | | |
|---|---|---|---|
| EP | 0 361 753 A A2 | 4/1990 | |
| EP | 0 540 244 A A2 | 5/1993 | |
| EP | 0 626 267 A A2 | 11/1994 | |
| EP | 0 689 936 A A2 | 1/1996 | |
| EP | 0 718 104 | 6/1996 | |
| JP | 4-178638 | 6/1992 | |
| JP | 9109378 A * | 4/1997 | B41J/2/01 |

OTHER PUBLICATIONS

European Search Report for Application No. 00126436.5–1251 dated May 17, 2002.

* cited by examiner

*Primary Examiner*—Anh T. N. Vo
*Assistant Examiner*—Blaise Mouttet

(57) ABSTRACT

Recording paper fed from a paper feed section comes in contact with a paper detection member of a detector unit and the paper detection member is rotated about a first fulcrum, shading the optical axis of an optical sensor. When the recording paper passes through and the paper detection member is brought out of contact with the recording paper, the paper detection member is restored to the former position and does not shade the optical axis. A carriage/cartridge detection member of the detector unit comes in contact with a carriage engagement part and a cartridge engagement part placed in a carriage and is rotated about a second fulcrum, shading the optical axis of the optical sensor. When the carriage/cartridge detection member is brought out of contact with the engagement parts, the carriage/cartridge detection member is restored to the former position and does not shade the optical axis.

24 Claims, 20 Drawing Sheets

DETECTOR UNIT AND INK CARTRIDGE INCORPORATED IN RECORDING APPARATUS, AND METHOD OF JUDGING PRESENCE OF THE INK CARTRIDGE USING THE DETECTOR UNIT

BACKGROUND OF THE INVENTION

This invention relates to a detector unit used with a recording apparatus such as a printer, a plotter, a facsimile, or a copier for detecting recording paper, a carriage, and an ink cartridge. The invention also relates to an ink cartridge preferably used with the above-mentioned recording apparatus and a method of detecting attachment state of the ink cartridge.

A recording apparatus such as an ink jet printer comprises a paper feed section for feeding recording paper into a record section and the record section for recording the fed recording paper, for example. The record section jets ink drops from a recording head attached to a carriage with reciprocating of the carriage and transports the recording paper in a subscanning direction. The ink drop jetting operation and the recording paper transport operation are performed in synchronization with each other, whereby recording (namely, printing) is executed on the recording paper.

Such a recording apparatus is provided with a paper detector for detecting the position of the recording paper sent from the paper feed section to the record section, the length of the recording paper, and the like. It is also provided with a standby position detector for detecting the position of the carriage in the main scanning direction, particularly the standby position, the reference position of the carriage in the main scanning direction (standby position). Further, the recording apparatus of the type wherein an ink cartridge is held detachably in the carriage is also provided with an ink cartridge detector for sensing whether or not an ink cartridge is held.

The related recording apparatus is provided with the paper detector, the standby position detector, and the ink cartridge detector separately. For example, the paper detector is placed on a paper feed passage from the paper feed section to the record section and the standby position detector is placed in the vicinity of the standby position of the carriage. The ink cartridge detector is placed in the carriage holding an ink cartridge.

Thus, the related recording apparatus is provided with the detectors in a one-to-one correspondence with the objects to be detected and thus the structure of the recording apparatus becomes complicated and the number of parts is increased; this is a problem. There are strong demands for decreasing costs and miniaturization for this kind of recording apparatus, and a decrease in the number of parts and simplification of the structure are demanded.

SUMMARY OF THE INVENTION

It is therefore an object of the invention to simplify the structure of a detector unit and decrease the number of parts.

In order to achieve the above object, according to the present invention, there is provided a detector unit incorporated in a recording apparatus which comprises:

- a carriage provided with a recording head and a cartridge holder in which an ink cartridge is detachably held;
- a record section in which the carriage is reciprocately moved in a main scanning direction to record information onto recording paper; and

- a paper feeding section for feeding the recording paper into the record section, the detector unit comprising:

- at least two of the following detection members:
  - a carriage detection member displaced by the main scanning movement of the carriage;
  - a cartridge detection member detectably displaced by the main scanning movement of the carriage when the ink cartridge is mounted in the cartridge holder; and
  - a paper detection member displaced by the recording paper fed into the record section; and
- a single detector for varying an output signal therefrom in accordance with the at least two detection members to recognize at least two of the carriage, the ink cartridge and the recording paper.

In this configuration, since the single detector is used to detect a plurality of detection objects, the structure of a recording apparatus can be simplified, the number of parts of the recording apparatus can be decreased, and the costs of the recording apparatus can be reduced.

Preferably, the paper detection member is placed on a transporting path of the recording paper in the record section so as to be movable between a first reference position and a first move position. The paper detection member is situated at the first reference position when the recording paper is not in contact therewith, and is situated at the first move position when the recording paper comes in contact therewith. A carriage engagement member is provided with the carriage. The carriage detection member is placed on a traveling path of the carriage engagement member so as to be movable between a second reference position and a second move position. The carriage detection member is situated at the second reference position when the carriage engagement member is not in contact therewith, and is situated at the second move position when the carriage engagement member comes in contact therewith. The detector detects at least one of the displacement of the paper detection member from the first reference position to the first move position and the displacement from the first move position to the first reference position. The detector also detects at least one of the displacement of the carriage detection member from the second reference position to the second move position and the displacement from the second move position to the second reference position.

Preferably, the carriage engagement member comes in contact with the carriage detection member when the carriage is situated at a standby position thereof.

In this configuration, the standby position, used as a reference position for the movement of the carriage, can be detected.

Preferably, the detector includes a photo emitter and a photo detector. The photo detector receives the light emitted from the photo emitter when the paper detection member is situated at the first reference position and the carriage detection member is situated at the second reference position. The light emitted from the photo emitter is shaded when the paper detection member is situated at the first move position and the carriage detection member is situated at the second move position.

In this configuration, the structure of the detector can be simplified, whereby the configuration of the detector unit and by extension the recording apparatus can be simplified and the manufacturing costs can also be reduced.

Preferably, the paper detection member is pivotable between the first reference position and the first move position about a first fulcrum which defines a first move end and a second move end opposed to the first move end through the first fulcrum in between. The recording paper comes in contact with a first contact portion provided on the first move end of the paper detection member. The light emitted from the photo emitter is shaded by a first shading plate formed on the second move end of the paper detection member.

Preferably, the carriage detection member is pivotable between the second reference position and the second move position about a second fulcrum which defines a first move end and a second move end opposed to the first move end through the second fulcrum in between. The carriage engagement member comes in contact with a second contact portion provided on the first move end of the carriage detection member. The light emitted from the photo emitter is shaded by a first shading plate formed on the second move end of the carriage detection member.

In the above configurations, since the paper detection member and the carriage detection member can be provided as simple shape members, manufacturing can be facilitated and the manufacturing costs can be reduced.

Preferably, a cartridge engagement member is provided with the carriage so as to be movable between an absence position and a presence position. The cartridge engagement member is situated at the absence position when the ink cartridge is not mounted in the cartridge holder, and is situated at the presence position when the ink cartridge is mounted in the cartridge holder. The cartridge engagement member is arranged away from the carriage engagement member in the main scanning direction, and arranged such that either the absence position or the presence position is to be abutted against the carriage detection member in accordance with the main scanning movement of the carriage. Respective widths of the carriage engagement member and the cartridge engagement member are made different from each other in the main scanning direction. The carriage detection member is situated at the second move position when the cartridge engagement member comes in contact with the carriage detection member.

Preferably, a plurality of ink cartridges are mounted in the cartridge holder. A plurality of cartridge engagement members are provided in association with the plural ink cartridges. The plural cartridge engagement members are arranged away from each other in the main scanning direction, and arranged such that either the absence position or the presence position is to be subsequently abutted against the carriage detection member in accordance with the main scanning movement of the carriage. Respective widths of the carriage engagement member and the cartridge engagement members are made different from each other in the main scanning direction. The carriage detection member is situated at the second move position when one of the cartridge engagement members comes in contact with the carriage detection member.

In the above configurations, the output signal of the detector varies depending on the engagement members. Therefore, the carriage and the cartridge can be distinguished from each other according to the simple structure.

Alternatively, the paper detection member is placed on a transporting path of the recording paper in the record section so as to be movable between a first reference position and a first move position. The paper detection member is situated at the first reference position when the recording paper is not in contact therewith, and is situated at the first move position when the recording paper comes in contact therewith. A cartridge engagement member is provided with the carriage so as to be movable between an absence position and a presence position. The cartridge engagement member is situated at the absence position when the ink cartridge is not mounted in the cartridge holder, and is situated at the presence position when the ink cartridge is mounted in the cartridge holder. The cartridge detection member is placed on a traveling path of the cartridge engagement member so as to be movable between a second reference position and a second move position. The cartridge detection member is situated at the second reference position when the cartridge engagement member is not in contact therewith, and is situated at the second move position when the cartridge engagement member comes in contact therewith. The detector detects at least one of the displacement of the paper detection member from the first reference position to the first move position and the displacement from the first move position to the first reference position. The detector also detects at least one of the displacement of the cartridge detection member from the second reference position to the second move position and the displacement from the second move position to the second reference position.

Preferably, a plurality of ink cartridges are mounted in the cartridge holder. A plurality of cartridge engagement members are provided in association with the plural ink cartridges. The plural cartridge engagement members are arranged away from each other in the main scanning direction, and arranged such that either the absence position or the presence position is to be subsequently abutted against the cartridge detection member in accordance with the main scanning movement of the carriage. The cartridge detection member is situated at the second move position when one of the cartridge engagement members comes in contact with the cartridge detection member. Respective widths of the cartridge engagement members are made different from each other in the main scanning direction.

Alternatively, a carriage engagement member is provided with the carriage. The carriage detection member is placed on a traveling path of the carriage engagement member so as to be movable between a first reference position and a first move position. The carriage detection member is situated at the first reference position when the carriage engagement member is not in contact therewith, and is situated at the first move position when the carriage engagement member comes in contact therewith. A cartridge engagement member is provided with the carriage so as to be movable between an absence position and a presence position. The cartridge engagement member is situated at the absence position when the ink cartridge is not mounted in the cartridge holder, and is situated at the presence position when the ink cartridge is mounted in the cartridge holder. The cartridge engagement member is arranged away from the carriage engagement member in the main scanning direction, and arranged such that either the absence position or the presence position is to be abutted against the carriage detection member in accordance with the main scanning movement of the carriage. Respective widths of the carriage engagement member and the cartridge engagement member are made different from each other in the main scanning direction. The detector detects at least one of the displacement of the carriage detection member from the first reference position to the first move position and the displacement from the first move position to the first reference position.

Preferably, the carriage engagement member comes in contact with the carriage detection member when the carriage is situated at a standby position thereof.

Preferably, a plurality of ink cartridges are mounted in the cartridge holder. A plurality of cartridge engagement members are provided in association with the plural ink cartridges. The plural cartridge engagement members are arranged away from each other in the main scanning direction, and arranged such that either the absence position or the presence position is to be subsequently abutted against the carriage detection member in accordance with the main scanning movement of the carriage. Respective widths of the carriage engagement member and the cartridge engagement members are made different from each other in the main scanning direction. The carriage detection member is situated at the first move position when one of the cartridge engagement members comes in contact with the carriage detection member.

Alternatively, at least the carriage detection member and the cartridge detection member are provided as the detection members. The cartridge detection member is situated on a traveling path of the carriage detection member only when the ink cartridge is mounted in the cartridge holder. The detector is arranged within a region in which the carriage is movable in the main scanning direction to detect the carriage detection member and the cartridge detection member.

In this configuration, since the carriage detection member and the cartridge detection member are provided with the carriage and are detected directly by the detector, the configuration of the detector unit and by extension the recording apparatus can be simplified and the manufacturing costs can also be reduced.

Preferably, the cartridge detection member is integrally formed with the ink cartridge.

Preferably, the cartridge detection member is integrally formed with the cartridge holder.

Preferably, the detector includes a photo emitter and a photo detector for receiving light emitted from the photo emitter. The carriage detection member and the cartridge detection member are shading projections which are to be passed between the photo emitter and the photo detector.

Preferably, respective widths of the carriage detection member and the cartridge detection member are made different from each other in the main scanning direction.

Preferably, a plurality of ink cartridges are mounted in the cartridge holder. A plurality of cartridge detection members are provided in association with the plural ink cartridges. Respective widths of the cartridge detection members are made different from each other in the main scanning direction.

Preferably, a transparent part is formed on at least one of the carriage detection member and the cartridge detection member.

Preferably, a plurality of ink cartridges are mounted in the cartridge holder. A plurality of cartridge detection members are provided in association with the plural ink cartridges. A transparent part is formed on at least one of the cartridge detection members.

According to the present invention, there is also provided an ink cartridge incorporated in a recording apparatus which comprises:

a carriage reciprocately moved in a main scanning direction, and provided with a recording head, a carriage detection member and a cartridge holder in which the ink cartridge is detachably held; and a detector arranged within a region in which the carriage is movable in the main scanning direction to detect the carriage detection member. The ink cartridge comprises a cartridge detection member situated on a traveling path of the carriage detection member to be detected by the detector.

Preferably, the detector includes a photo emitter and a photo detector for receiving light emitted from the photo emitter. The cartridge detection member is a shading projection which is to be passed between the photo emitter and the photo detector.

Preferably, a plurality of ink cartridges are mounted in the cartridge holder. A plurality of cartridge detection members are provided in association with the plural ink cartridges. Respective widths of the cartridge detection members are made different from each other in the main scanning direction.

Preferably, respective widths of the carriage detection member and the cartridge detection member are made different from each other.

Preferably, a plurality of ink cartridges are mounted in the cartridge holder. A plurality of cartridge detection members are provided in association with the plural ink cartridges. A transparent part is formed on at least one of the cartridge detection members.

According to the present invention, there is also provided an ink cartridge incorporated in a recording apparatus which comprises:

a carriage reciprocately moved in a main scanning direction, and provided with a recording head, a carriage detection member and a cartridge holder in which the ink cartridge is detachably held; and a detector arranged within a region in which the carriage is movable in the main scanning direction to detect the carriage detection member. The ink cartridge comprises a cartridge detection member to be detected by the detector when the carriage is moved.

Preferably, the detector includes a photo emitter and a photo detector for receiving light emitted from the photo emitter. The cartridge detection member is a shading projection which is to be passed between the photo emitter and the photo detector.

Preferably, the cartridge detection member also serves as the carriage detection member.

Preferably, a plurality of ink cartridges are mounted in the cartridge holder. A plurality of cartridge detection members are provided in association with the plural ink cartridges. Respective widths of the cartridge detection members are made different from each other in the main scanning direction.

According to the present invention, there is also provided a method of judging presence of an ink cartridge, comprising the steps of:

preparing a recording apparatus which comprises:

a carriage provided with a recording head, a carriage detection member and a cartridge holder in which the ink cartridge is detachably held;

a record section in which the carriage is reciprocately moved in a main scanning direction to record information onto recording paper;

a paper feeding section for feeding the recording paper into the record section; and a detector arranged within a region in which the cartridge is movable in the main scanning direction to detect the carriage detection member;

preparing an ink cartridge provided with a cartridge detection member situated on a traveling path of the carriage detection member to be detected by the detector, only when the ink cartridge is mounted in the cartridge holder; displaced by the main scanning movement of the carriage is provided;

moving the carriage to a first position where the carriage detection member is detected by the detector;

moving the carriage from the first position to a second position where the cartridge detection member is detected by the detector; and determining whether the ink cartridge is mounted in the cartridge holder with reference to an output signal of the detector.

Preferably, the carriage is moved by a pulse motor which is operated in accordance with the number of input pulse. The distance between the first position and the second position is managed by the number of pulses to be input into the pulse motor.

BRIEF DESCRIPTION OF THE DRAWINGS

In the accompanying drawings:

FIG. 18A is a plan view and FIG. 18B is a sectional view;

FIG. 19A is a plan view, FIG. 19B is a sectional view, and FIG. 19C is a sectional view to show a state in which no ink cartridge is placed.

DETAILED DESCRIPTION OF THE PREFERRED EMBODIMENTS

Referring now to the accompanying drawings, there are shown preferred embodiments of the invention. In the description that follows, as "recording apparatus" according to the invention, ink jet printers (simply, printers) are taken as examples.

Figure 1:
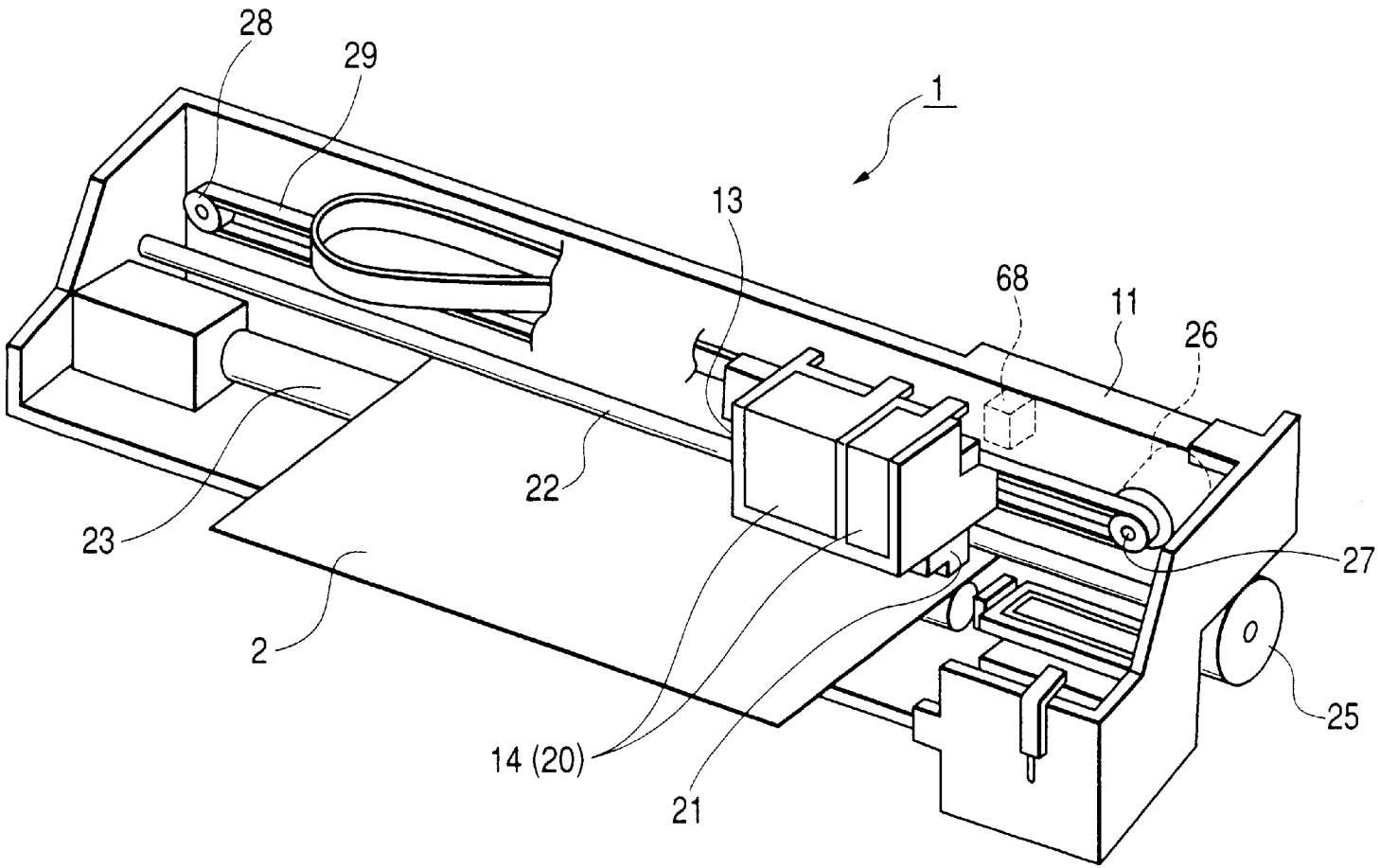
FIG. 1 is a perspective view to show a schematic structure of the inside of a printer.
Figure 2:
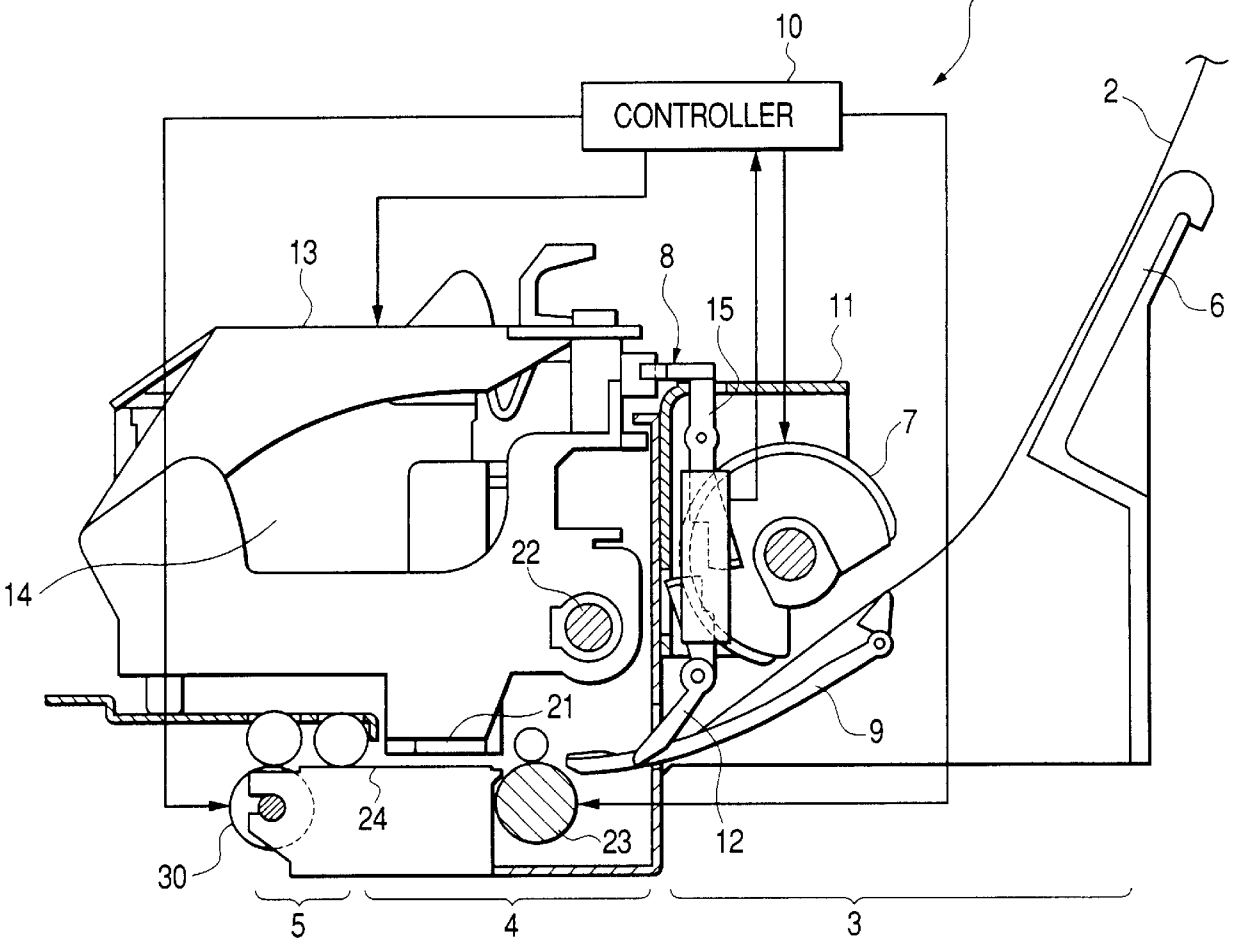
FIG. 2 is a right schematic side view, partly in cross section, of the printer.

First, the general configuration of the printer will be discussed. FIG. 1 is a perspective view to show a schematic structure of the inside of a printer 1 and FIG. 2 is a right schematic side view, partly in cross section, of the printer 1. As shown in the figures, the printer 1 comprises a paper feed section 3 for feeding recording paper 2, a kind of print record medium, a record section 4 for recording the fed recording paper 2, and a paper discharge section 5 for transporting the recorded recording paper 2 in a discharge direction.

The paper feed section 3 comprises a support plate 6 being placed in the rear part of the printer 1 for guidably supporting the recording paper 2, a paper feed roller 7 for coming in contact with the recording paper 2 and feeding the recording paper 2 to the side of the record section 4, a detector unit 8, and a guide plate 9 for guiding the recording paper 2 fed by the paper feed roller 7 to the record section 4. A paper feed motor (not shown) operated under the control of a controller 10 is joined to the paper feed roller 7 and the paper feed roller 7 is rotated by the drive force of the paper feed motor.

The detector unit 8 is attached to a frame 11 of the printer 1. The detector unit 8 comprises a paper detection member 12 for detecting the recording paper 2, a carriage/cartridge detection member 15 for detecting a standby position (standby position) at which a carriage 13 stands by and detecting the presence or absence of an ink cartridge 14 held in the carriage 13, and an optical sensor 16 of transmission type, a kind of detector of the invention (see FIG. 3). Output of the optical sensor 16 (namely, electric signal) is given to the controller 10. The detailed configuration and function of the detector unit 8 will be discussed later.

The record section 4 comprises the carriage 13 provided with a cartridge holder section 20 for detachably holding an ink cartridge 14, the carriage 13 to which a recording head is attached, a carriage guide shaft 22 for guiding the carriage 13 along the main scanning direction (paper width direction), a paper transport roller 23 for transporting the recording paper 2, a platen 24 for guiding the recording paper 2, and a carriage scan mechanism for moving the carriage 13 along the carriage guide shaft 22.

The paper transport roller 23 is made up of a large-diameter drive roller at a lower position and a small-diameter driven roller at an upper position. A paper feed motor 25 controlled by the controller 10 is joined to the drive roller and the drive roller is rotated by the drive force of the paper feed motor 25. The driven roller is rotated in conjunction with the rotation of the drive roller.

As shown in FIG. 1, the carriage scan mechanism is made up of a carriage motor 26 placed on one end side of the left and right of the frame 11, a drive pulley 27 connected to the rotation shaft of the carriage motor 26, a driven pulley 28 placed on an opposite end side of the left and right of the frame 11, a timing belt 29 placed on the drive pulley 27 and the driven pulley 28 and connected to the carriage 13, the controller 10 for controlling rotation drive of the carriage motor 26, and the like. In the embodiment, the carriage motor 26 is implemented as a pulse motor rotated as much as the amount responsive to the number of supplied pulse signals. In the carriage scan mechanism, the move distance of the carriage 13 per pulse is defined and thus the carriage 13 can be moved by any desired distance by setting the number of pulses supplied to the pulse motor. The detailed configuration and function of the carriage 13 will be discussed later.

The paper discharge section 5 comprises a paper discharge roller 30 consisting of a large-diameter drive roller at a lower position and a small-diameter driven roller at an upper position. A paper discharge motor (not shown) controlled by the controller 10 is joined to the drive roller and the drive roller is rotated by the drive force of the paper discharge motor and the driven roller is rotated in conjunction with the rotation of the drive roller.

In the described printer 1, recording (printing) is executed on the recording paper 2 as follows: The paper feed roller 7 is rotated clockwise in FIG. 2, whereby the recording paper 2 is fed into the paper transport roller 23. At this time, the detector unit 8 detects the recording paper 2. The recording paper 2 fed from the paper feed roller 7 is sandwiched and transported between the drive roller and the driven roller making up the paper transport roller 23 in the subscanning direction and is sent onto the platen 24. On the platen 24, while the carriage 13 is reciprocated in the main scanning direction, ink drops are jetted from the recording head 21, thereby recording on the recording paper 2. The recorded recording paper 2 is sandwiched and transported between the drive roller and the driven roller of the paper discharge roller 30 and is discharged to the outside of the printer 1.

Next, the main parts of the printer 1 will be discussed.

Figure 3C:
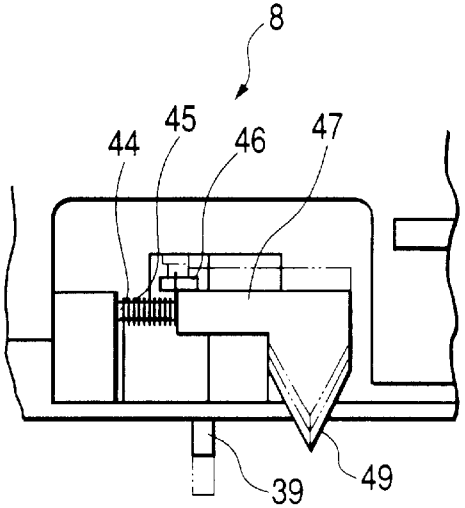
FIG. 3C is a plan view (top view) of the detector unit.
Figure 3B:
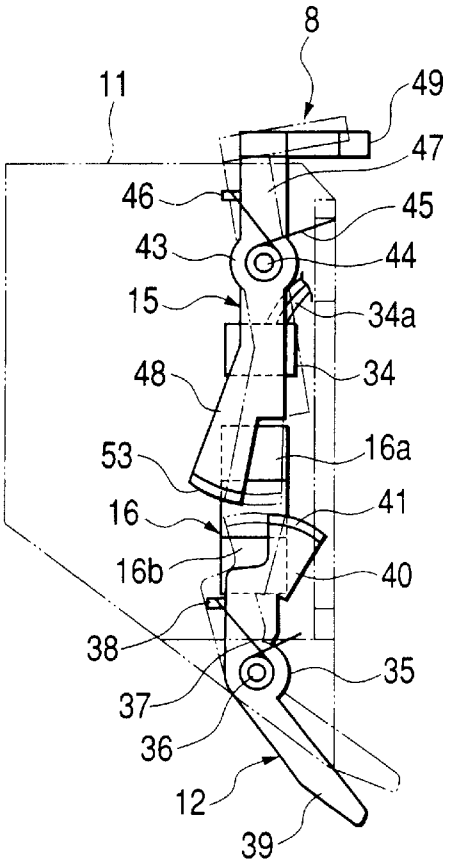
FIG. 3B is a left side view of the detector unit.
Figure 3A:
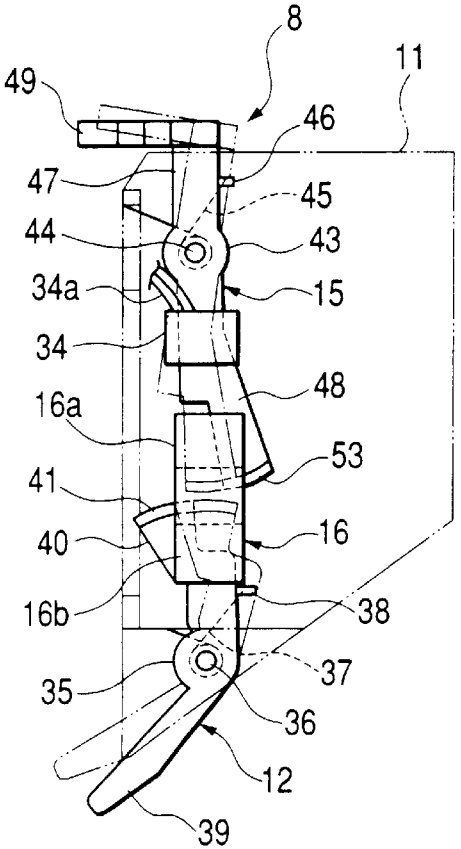
FIG. 3A is a right side view of a detector unit.
Figure 4B:
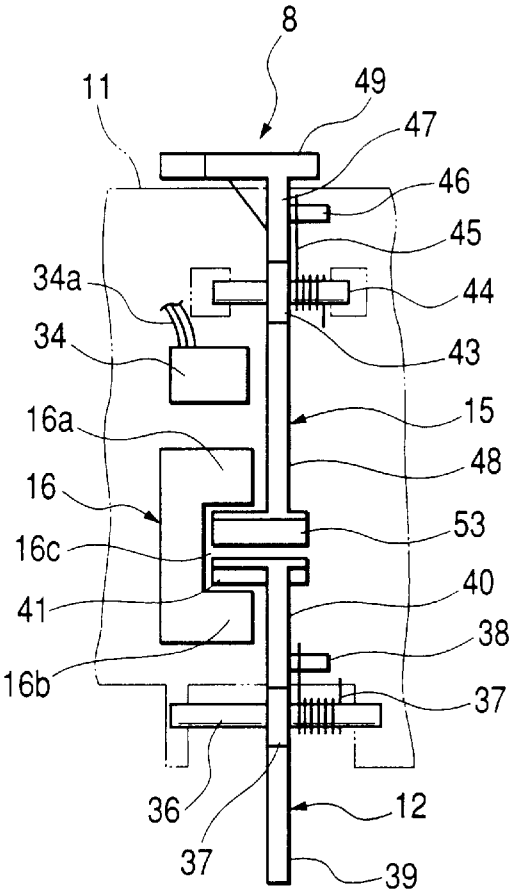
FIG. 4A is a front view of the detector unit and FIG. 4B is a rear view of the detector unit.
Figure 4A:
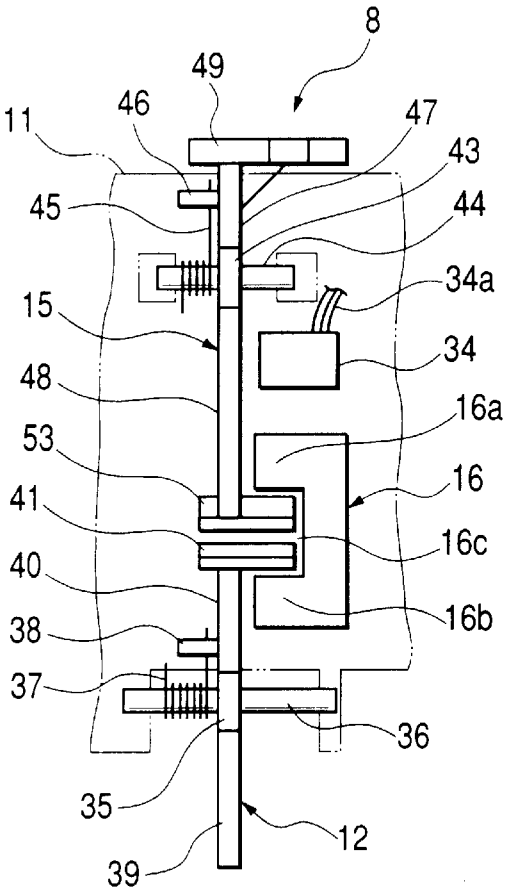

First, the detector unit 8 will be discussed. FIGS. 3 and 4 show the structure of the detector unit 8. FIG. 3A is a right side view of the detector unit 8, FIG. 3B is a left side view of the detector unit 8, and FIG. 3C is a plan view (top view) of the detector unit 8. FIG. 4A is a front view of the detector unit 8 and FIG. 4B is a rear view of the detector unit 8.

The detector unit 8 comprises the above-mentioned paper detection member 12, the above-mentioned carriage/cartridge detection member 15 serving not only as a carriage detection member of the invention, but also as a cartridge detection member, the above-mentioned optical sensor 16, a kind of detector of the invention, and a terminal 34 to which a signal line 34*a* for sending a signal of the optical sensor 16 to the controller 10 is connected.

The paper detection member 12 is at a first reference position as indicated by the solid line in FIG. 3A in a state in which the paper detection member 12 is not in contact with the recording paper 2 fed into the record section 4. The paper detection member 12 is at a first move position as indicated by the phantom line in FIG. 3A in a state in which the paper detection member 12 is in contact with the recording paper 2. Likewise, the carriage/cartridge detection member 15 is at a second reference position (also a third reference position; this also applies in the description to follow) as indicated by the solid line in FIG. 3A in a state in which the carriage/cartridge detection member 15 is in contact with neither the carriage 13 nor the ink cartridge 14. The carriage/cartridge detection member 15 is at a second move position (also a third move position; this also applies in the description to follow) as indicated by the phantom line in FIG. 3A in a state in which the carriage/cartridge detection member 15 is in contact with either the carriage 13 or the ink cartridge 14.

The optical sensor 16 comprises a photo emitter 16*a* and a photo detector 16*b* being placed facing the photo emitter 16*a* for receiving light therefrom. In the embodiment, the photo detector 16*b* is placed with a gap 16*c* (see FIGS. 4A, 4B) opened below the photo emitter 16*a*. Therefore, the optical sensor 16 has an optical axis formed in a vertical direction from the photo emitter 16*a* at the upper position to the photo detector 16*b* at the lower position in the gap 16*c*.

At a center portion of the paper detection member 12, a first fulcrum 35 which becomes the center of rotation is provided. A rotation shaft 36 is formed integrally with the first fulcrum 35 and is extended from left to right (namely, in the main scanning direction) and is attached to the frame 11 for rotation. The paper detection member 12 is rotated about the rotation shaft 36 and thus is displaced between the first reference position and the first move position. An spring 37 (torsion coil spring) is attached surrounding the rotation shaft 36. The spring 37 is retained at one end part on the frame 11 and at an opposite end part on a retention piece 38 formed integrally with the paper detection member 12. The urging force of the spring 37 acts so as to place the paper detection member 12 at the first reference position. The urging force of the spring 37 is set to such an extent that when the recording paper 2 comes in contact with a first contact part 39, the paper detection member 12 can rotate clockwise without obstructing feed of the recording paper 2.

The first contact part 39 is formed integrally at the tip of the lower side (one side) below the first fulcrum 35 in the paper detection member 12 and a first shading part 40 is formed integrally at the tip of the upper side (opposite side) above the first fulcrum 35. The first contact part 39 is placed so that it is disposed at the paper feed passage of the recording paper 2 from the upstream portion of the paper feed passage to the downstream side in the paper feed direction and that when the recording paper 2 passes through the paper feed passage, the tip comes in contact with the recording paper 2. A first shading plate 41 projected to one side is formed integrally at the tip of the first shading part 40 (upper end part). At the first reference position, the first shading plate 41 is placed at a position not shading the optical axis of the optical sensor 16; at the first move position, the first shading plate 41 is displaced to a position shading the optical axis of the optical sensor 16.

At a center portion of the carriage/cartridge detection member 15, a second fulcrum 43 which becomes the center of rotation is provided. A rotation shaft 44 is formed integrally with the second fulcrum 43 and is extended from side to side and is attached to the frame 11 for rotation. The carriage/cartridge detection member 15 is rotated about the rotation shaft 44 and thus is displaced between the second reference position and the second move position. A spring 45 (torsion coil spring) is attached surrounding the rotation shaft 44. The spring 45 is retained at one end part on the frame 11 and at an opposite end part on a retention piece 46 formed integrally with the carriage/cartridge detection member 15. The urging force of the spring 45 acts so as to place the carriage/cartridge detection member 15 at the second reference position.

A second contact part 47 is formed integrally at the tip of the upper side (one side) above the second fulcrum 43 in the carriage/cartridge detection member 15 and a second shading part 48 is formed integrally at the tip of the lower side (opposite side) below the second fulcrum 43. A contact end part 49 having a sharp tip is projected in the perpendicular direction from the main body of the second contact part 43. The contact end part 49 projects into the reciprocating path of the carriage 13 at the second reference position and enters a state in which it can come in contact with a carriage engagement part 50 (see FIG. 8) serving as a carriage engagement member of the invention and a first cartridge engagement part 51 and a second cartridge engagement part 52 (see FIG. 8) serving as cartridge engagement members.

When the engagement part 50, 51, 52 and the contact end part 49 come in contact with each other, the carriage/cartridge detection member 15 is displaced to the second move position accordingly. The contact end part 49 is placed so as to come in contact with the carriage engagement part 50 in a state in which the carriage 13 is at the standby position. The urging force of the spring 45 is set to such an extent that the carriage engagement part 50, the first cartridge engagement part 51, or the second cartridge engagement part 52 and the contact end part 49 come in contact with each other, the carriage/cartridge detection member 15 can be displaced to the second move position, and movement of the carriage 13 is not obstructed.

A second shading plate 53 projected to one side is formed integrally at the tip of the second shading part 48 (lower end part). At the second reference position, the second shading plate 53 is placed at a position not shading the optical axis of the optical sensor 16; at the second move position, the second shading plate 53 is displaced to a position shading the optical axis of the optical sensor 16.

Figure 5:
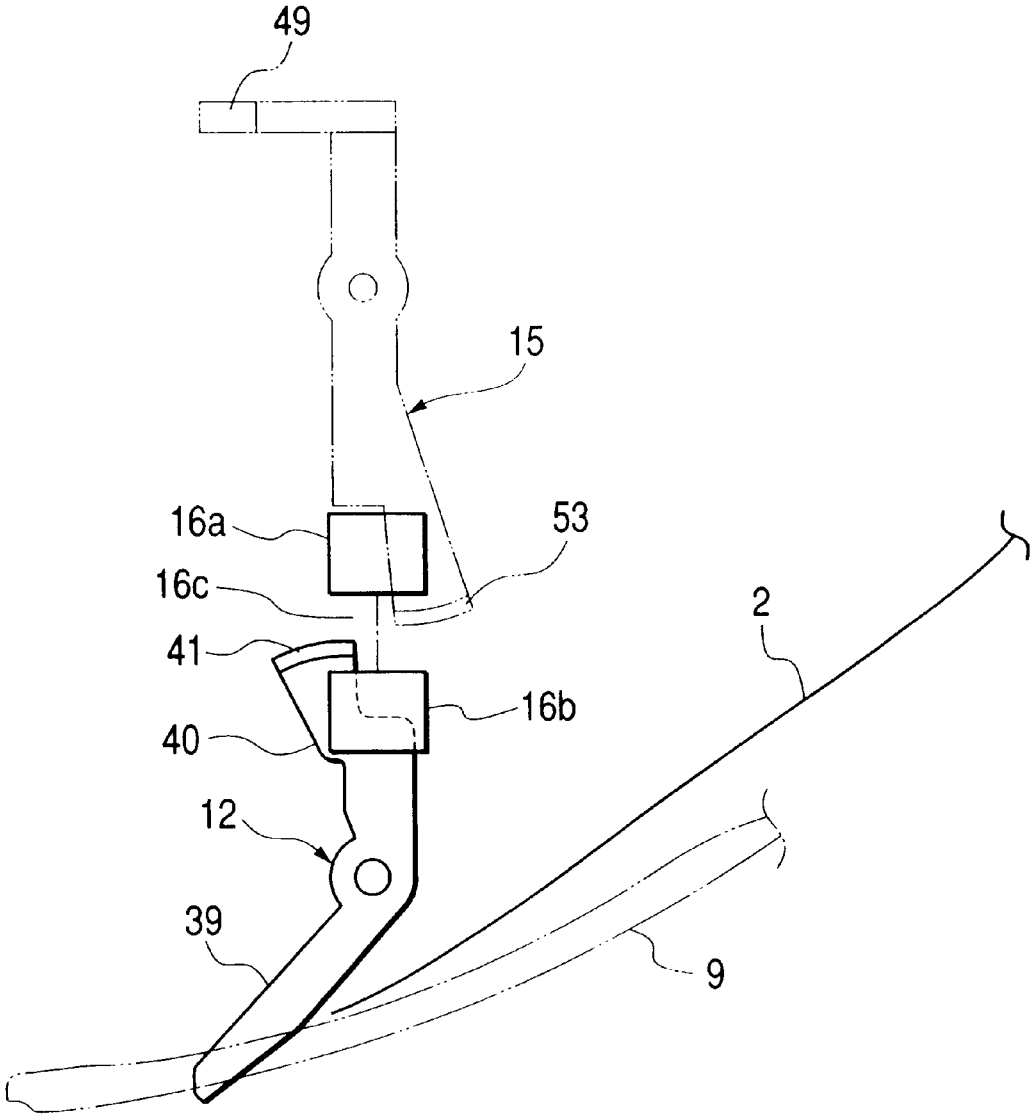
FIG. 5 is a drawing to show the state before the tip of recording paper comes in contact with a paper detection member.
Figure 6:
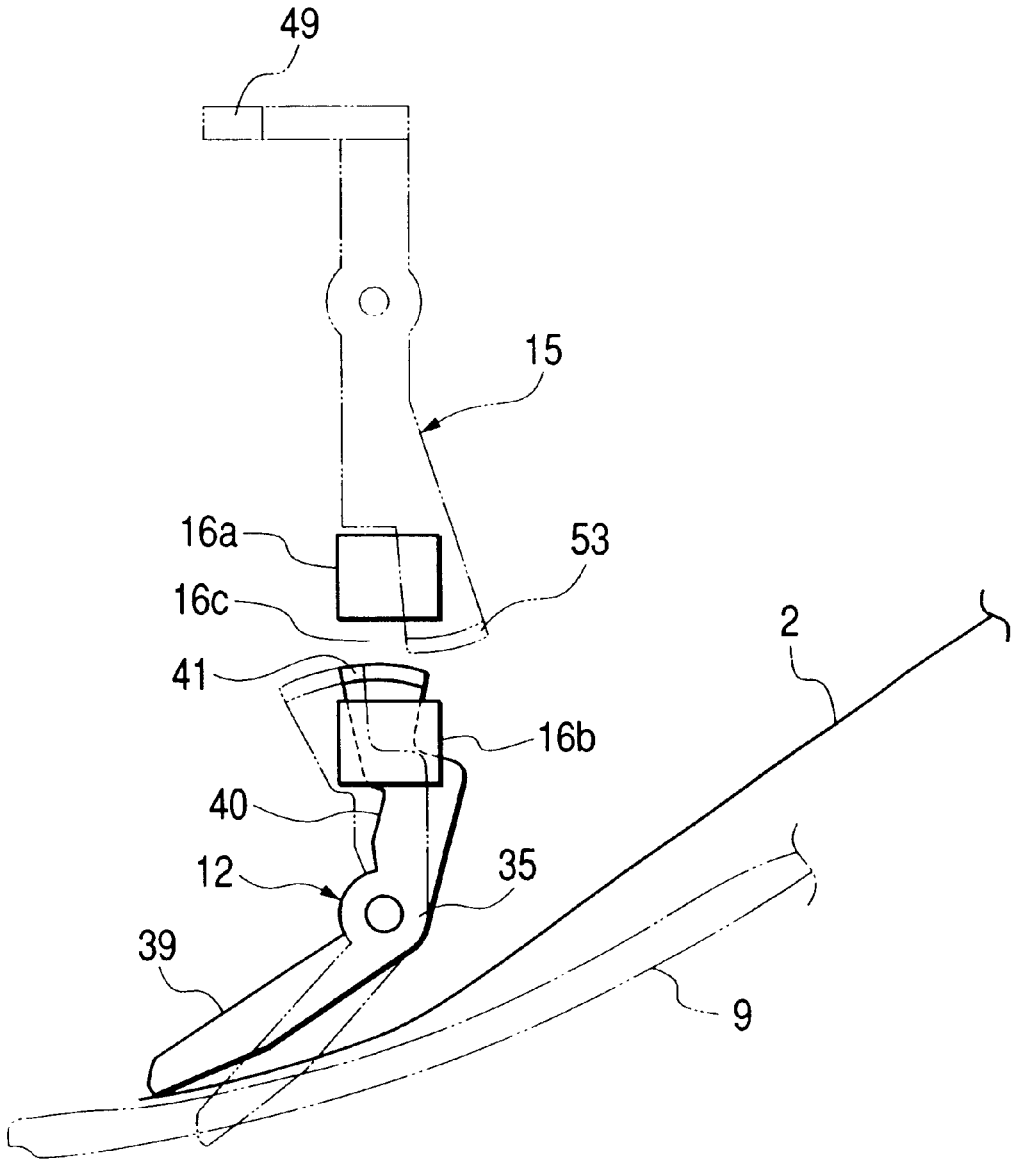
FIG. 6 is a drawing to show the state in which the recording paper is in contact with the paper detection member.
Figure 7:
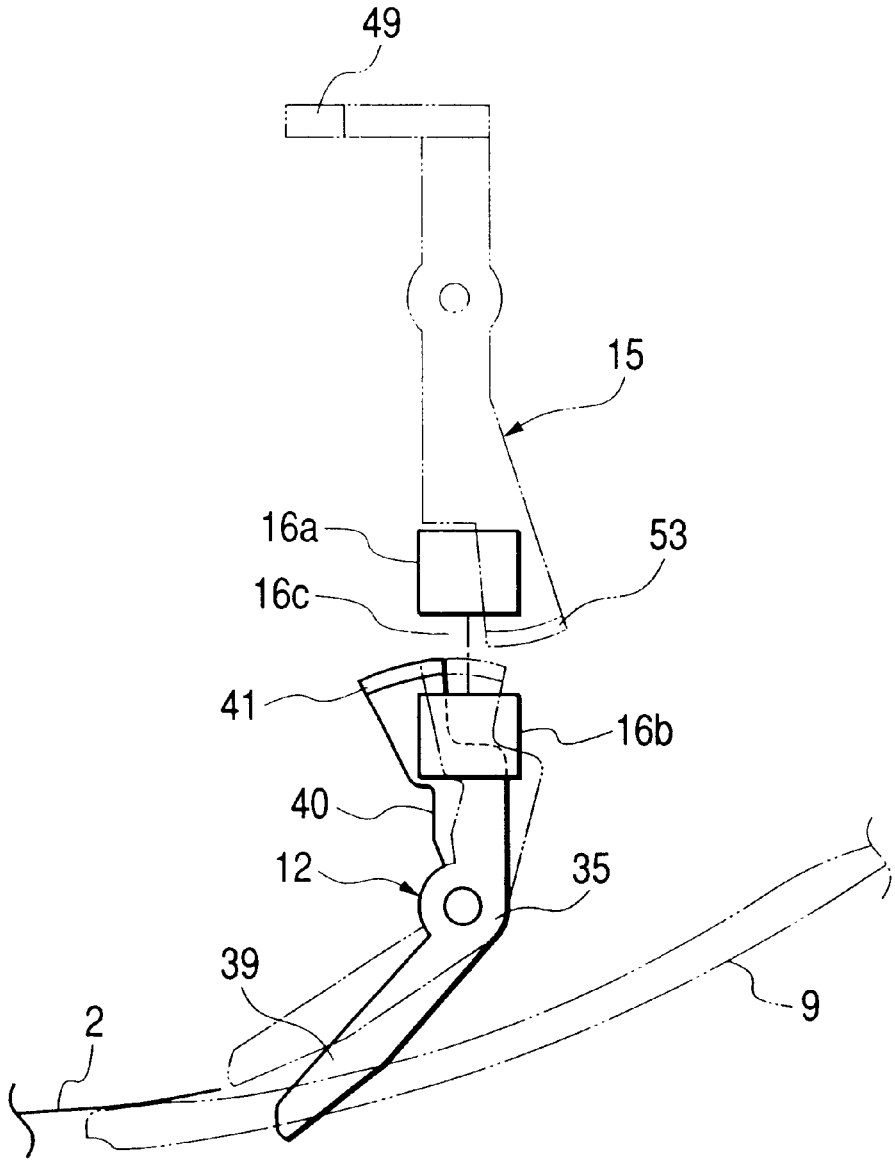
FIG. 7 is a drawing to show the state after the recording paper passes through the paper detection member.

Next, the detection operation of the recording paper 2 by the described detector unit 8 will be discussed. FIGS. 5 to 7 are drawings to show how the detector unit 8 detects the recording paper 2 when the recording paper 2 is fed from the paper feed section 3 to the record position. That is, FIG. 5 shows the state before the tip of the recording paper 2 comes in contact with the paper detection member 12, FIG. 6 shows the state in which the recording paper 2 is in contact with the paper detection member 12, and FIG. 7 shows the state after the recording paper 2 passes through the paper detection member 12.

When the recording paper 2 is detected, the carriage/cartridge detection member 15 is placed at the second reference position to retreat the second shading plate 53 from the optical axis of the optical sensor 16 and change output of the optical sensor 16 as the paper detection member 12 is displaced. Therefore, before the recording paper 2 is detected, the controller 10 controls the position of the carriage 13 so that the carriage engagement part 50, the first cartridge engagement part 51, and the second cartridge engagement part 52 and the contact end part 49 do not come in contact with each other.

As shown in FIG. 5, the paper detection member 12 is placed at the first reference position by the urging force of the spring 45 in a state in which the recording paper 2 is fed from the paper feed section 3 to the record section 4 and the tip of the recording paper is not yet in contact with the paper detection member 12. At the first reference position, the first shading plate 41 of the paper detection member 12 does not shade the optical axis of the optical sensor 16. Therefore, light from the photo emitter 16*a* is received at the photo detector 16*b* (hereinafter, this light reception state will be also referred to as OFF state of the optical sensor 16). Consequently, an electric signal corresponding to the light reception state is output from the photo detector 16*b*. The output from the photo detector 16*b* is sent to the controller 10 via the signal line 34*a*. The controller 10 senses based on the output from the photo detector 16*b* that the recording paper 2 is not yet fed.

Then, when the recording paper 2 is further fed and the recording paper 2 and the first contact part 39 come in contact with each other, the first contact part 39 is pushed out by the fed recording paper 2 as shown in FIG. 6, whereby the paper detection member 12 is rotated about the first fulcrum 35 clockwise against the urging force of the spring 45 and is displaced from the first reference position (indicated by the phantom line) to the first move position (indicated by the solid line). Therefore, the first shading plate 41 shades the optical axis and it becomes impossible for the photo detector 16*b* to receive light from the photo emitter 16*a* (hereinafter, this no light reception state will be also referred to as ON state of the optical sensor 16). Consequently, output from the photo detector 16*b* changes. The output from the photo detector 16*b* is sent to the controller 10 via the signal line 34*a*. The controller 10 senses based on the output change that the tip of the recording paper 2 reaches the paper detection member 12.

Subsequently, when the recording paper 2 is further fed and the rear end of the recording paper 2 leaves the first contact part 39 of the paper detection member 12 (namely, when the recording paper 2 and the paper detection member 12 are brought out of contact with each other), the paper detection member 12 is restored from the first move position (indicated by the phantom line) to the first reference position (indicated by the solid line) by the urging force of the spring 45 as shown in FIG. 7. Since the first shading plate 41 is retreated from the optical axis of the optical sensor 16 as the paper detection member 12 is restored, the photo detector 16*b* again receives light from the photo emitter 16*a*. Consequently, output from the photo detector 16*b* changes to the OFF state. This state change is sent to the controller 10 via the signal line 34*a*. The controller 10 senses that the rear end of the recording paper 2 leaves the paper detection member 12.

The controller 10 uses the tip position and the rear end position of the recording paper 2 thus sensed to control recording.

Figure 8:
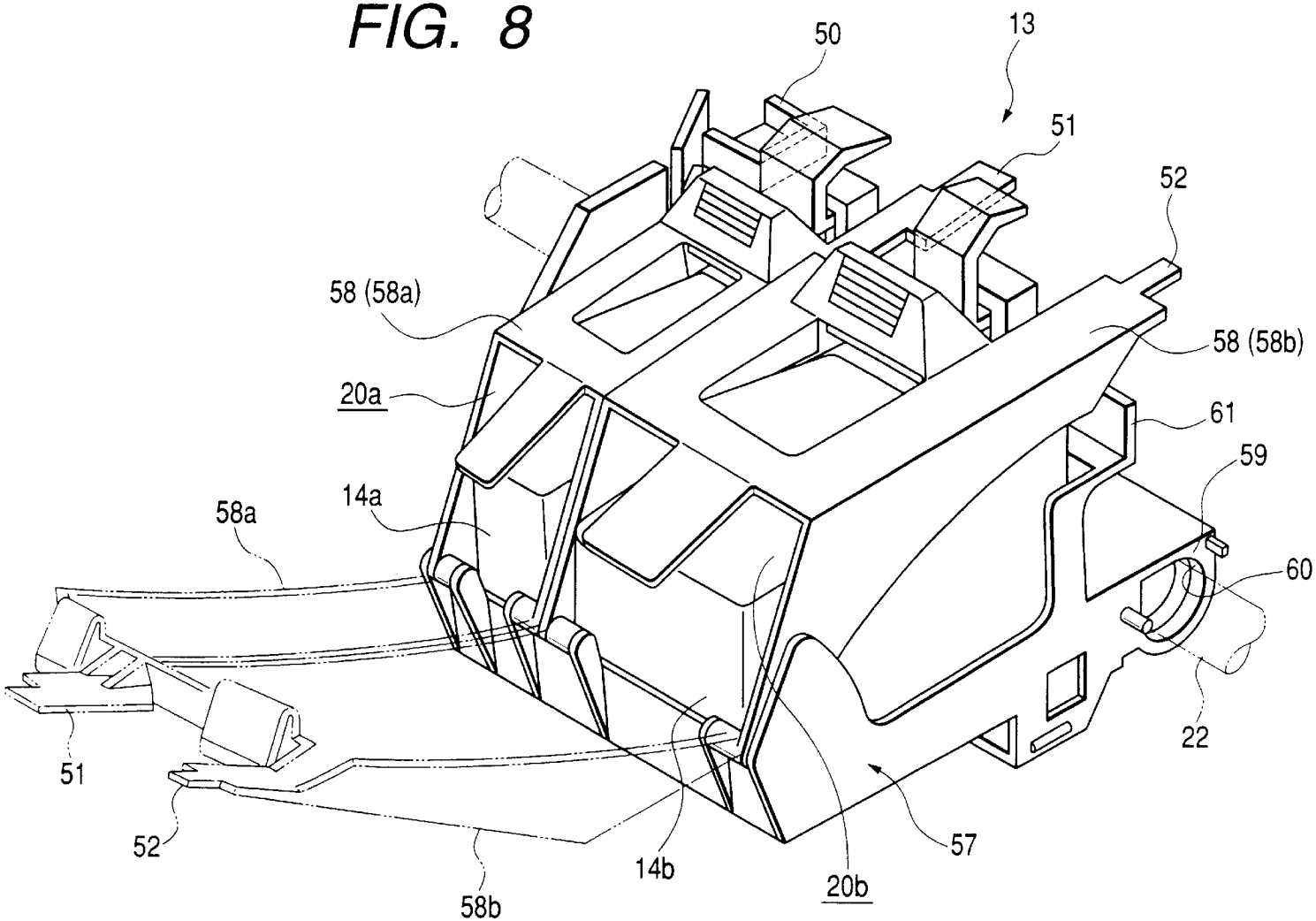
FIG. 8 is a perspective view to show the general configuration of a carriage.
Figure 9:
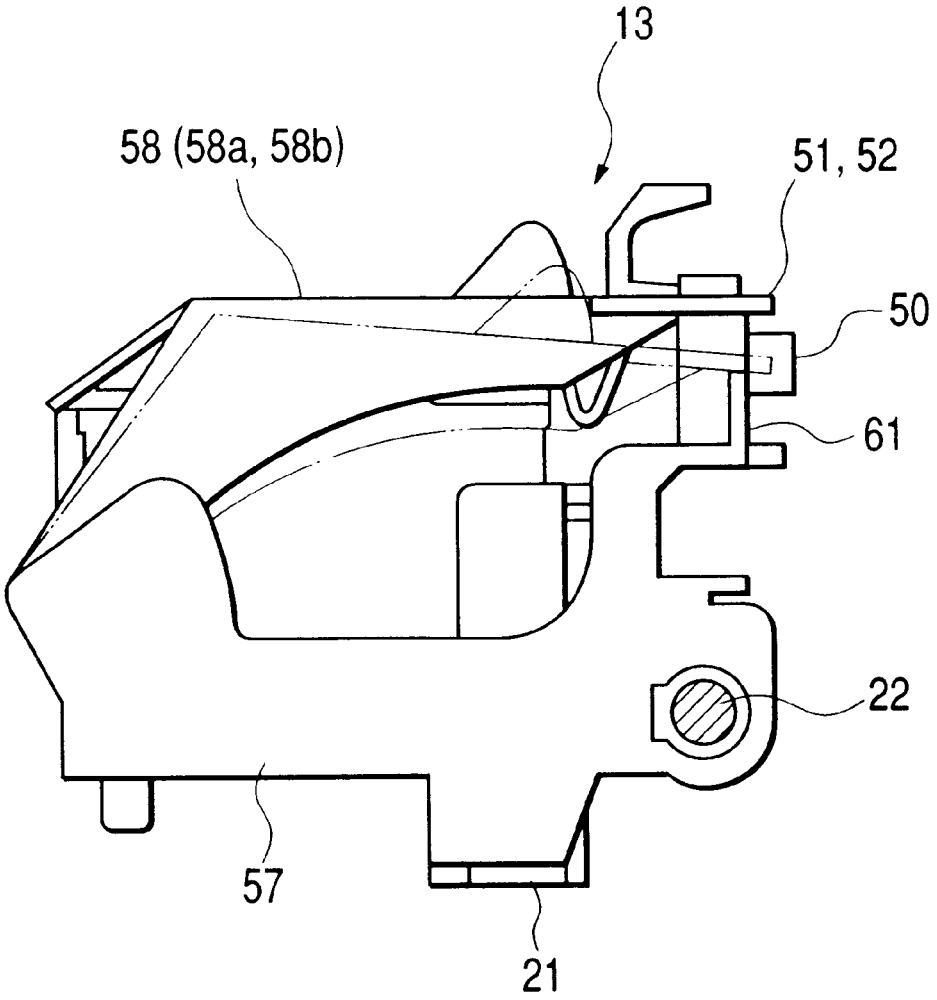
FIG. 9 is a right side view of the carriage.
Figure 10:
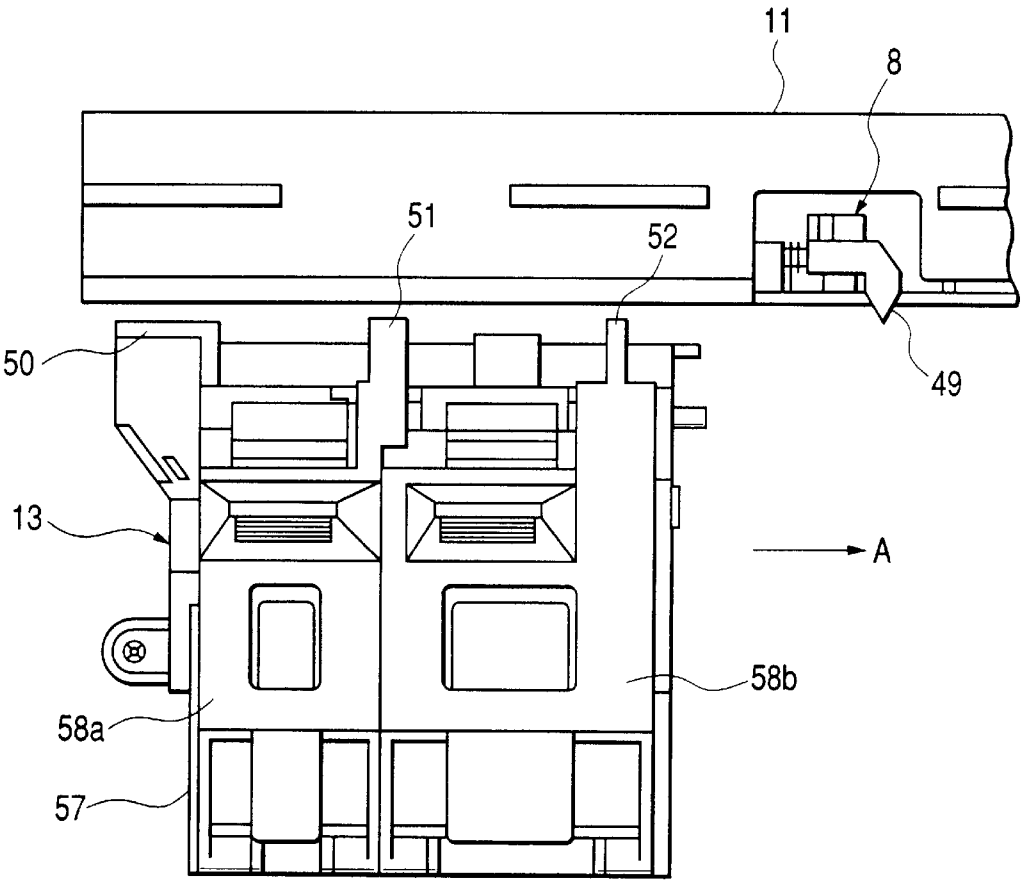
FIG. 10 is a plan view to show the carriage and the detector unit.

Next, the configuration of the described carriage 13 will be discussed. FIG. 8 is a perspective view to show the general configuration of the carriage 13. FIG. 9 is a right side view of the carriage 13. FIG. 10 is a plan view (top view) to show the carriage 13 and the detector unit 8.

As shown in FIG. 8, the carriage 13 is a box-like body comprising a main body 57 formed of a synthetic resin material and a lid member 58 formed of a synthetic resin material. The cartridge comprises a storage chamber for detachably holding the ink cartridge 14, namely, the above-mentioned cartridge holder section 20.

A bearing part 59 is placed at the lower end part behind the carriage main body 57. A through hole 60 is made in the bearing part 59 and a carriage guide shaft 22 is inserted into the through hole 60. Therefore, the carriage 13 is guided in the main scanning direction as the bearing part 59 slides along the carriage guide shaft 22.

The above-mentioned carriage engagement part 50 used to detect the position of the carriage 13 is projected backward at the left part of the upper end part behind the carriage main body 57. When the carriage 13 is at the standby position, the carriage engagement part 50 comes in contact with the contact end part 49 of the carriage/cartridge detection member 15 and displaces the paper detection member 12 to the second move position.

The lid member 58 is attached to the carriage main body 57 for rotation via a fulcrum shaft. The lid member 58 is rotated about the fulcrum shaft, whereby it can be displaced to a closed state indicated by solid lines in FIG. 8 and an open state indicated by phantom lines in FIG. 8. When a first lid member 58*a* is opened, a cartridge hold member 20*a* for a black ink cartridge 14*a* storing black ink appears; when a second lid member 58*b* is opened, a cartridge hold member 20*b* for a color ink cartridge 14*b* storing color ink (for example, cyan ink, magenta ink, yellow ink) appears.

Therefore, the lid members 58*a* and 58*b* are opened, whereby the black ink cartridge 14*a* and the color ink cartridge 14*b* can be stored and held in the carriage 13. To record on the recording paper 2, the lid members 58*a* and 58*b* are closed.

In an absence state in which the black ink cartridge 14*a* is not held in the cartridge hold member 20*a*, the first lid member 58*a* is closed, whereby it abuts a rear wall 61 of the carriage main body 57 and stops at an absence position indicated by the phantom line in FIG. 9. On the other hand, in a presence state in which the black ink cartridge 14*a* is held in the cartridge hold member 20*a*, the first lid member 58*a* is closed, whereby it abuts the top of a rear wall 61 of the black ink cartridge 14*a* and stops at a presence position lifted up above the absence position. This also applies to the second lid member 58*b*.

The above-mentioned first cartridge engagement part 51 is projected backward at the rear end part of the lid member 58 and the above-mentioned second cartridge engagement part 52 is projected backward at the rear end part of the other lid member 58. The first cartridge engagement part 51 and the second cartridge engagement part 52 are spaced from each other in the main scanning direction and are also spaced from the carriage engagement part 50. The first cartridge engagement part 51 and the second cartridge engagement part 52 are positioned on the traveling path of the carriage engagement part 50 in the main scanning direction at the absence position, and are placed at positions where they come in contact with the contact end part 49 of the carriage/cartridge detection member 15 with a movement of the carriage 13. On the other hand, at the presence position, the first cartridge engagement part 51 and the second cartridge engagement part 52 are displaced to positions above the absence position and thus if the carriage 13 is moved, they do not come in contact with the contact end part 49 of the detector unit 8.

The width of the first cartridge engagement part 51 in the main scanning direction and that of the second cartridge engagement part 52 in the main scanning direction are set to different widths. In the embodiment, the first cartridge engagement part 51 has the width almost twice that of the second cartridge engagement part 52. The width of the carriage engagement part 50 in the main scanning direction is also set to a width different from the widths of the first cartridge engagement part 51 and the second cartridge engagement part 52. In the embodiment, it is set to a width twice or more that of the first cartridge engagement part 51.

Figure 11:
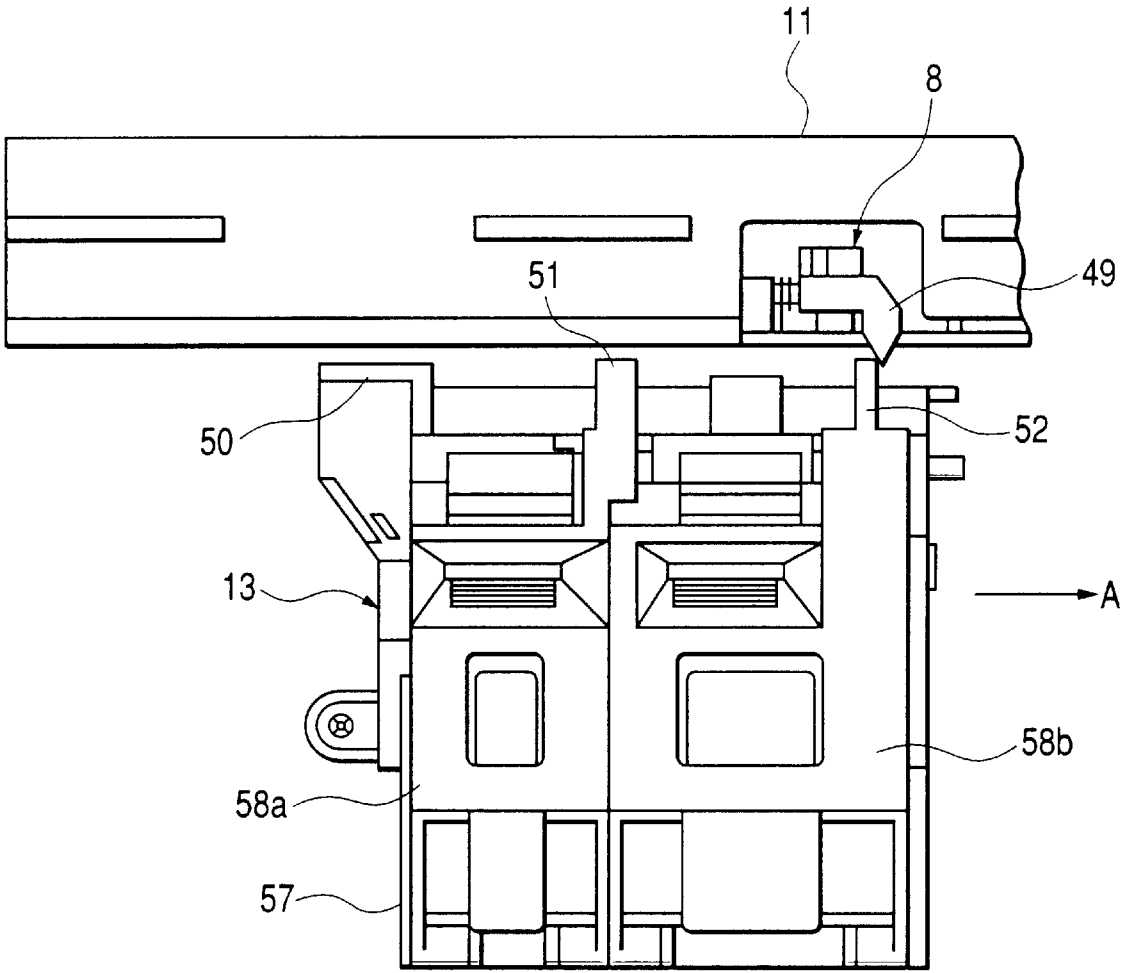
FIG. 11 is a schematic representation to show detection of an ink cartridge and detection of the standby position of a carriage.
Figure 12:
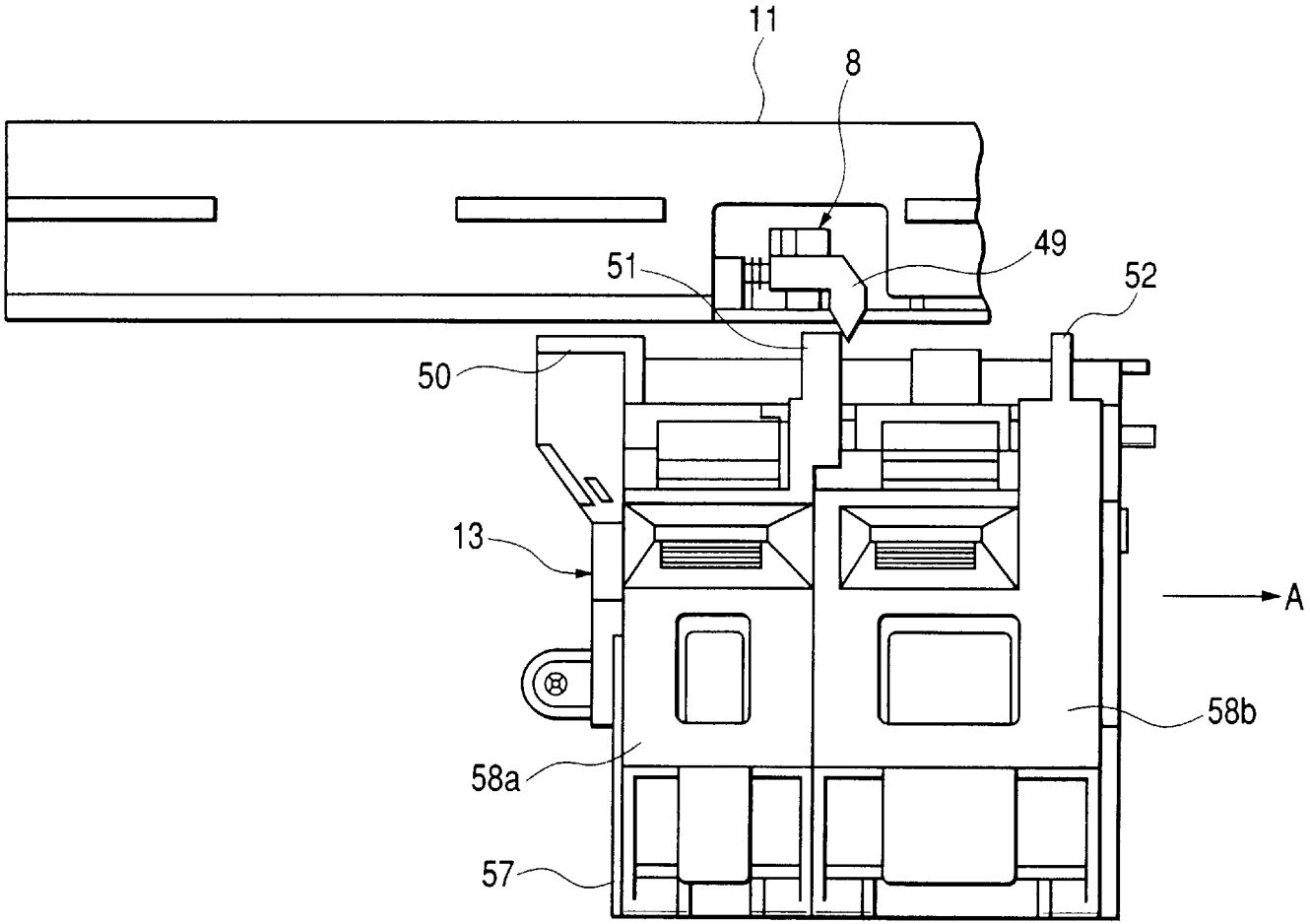
FIG. 12 is a schematic representation to show detection of an ink cartridge and detection of the standby position of a carriage.
Figure 13:
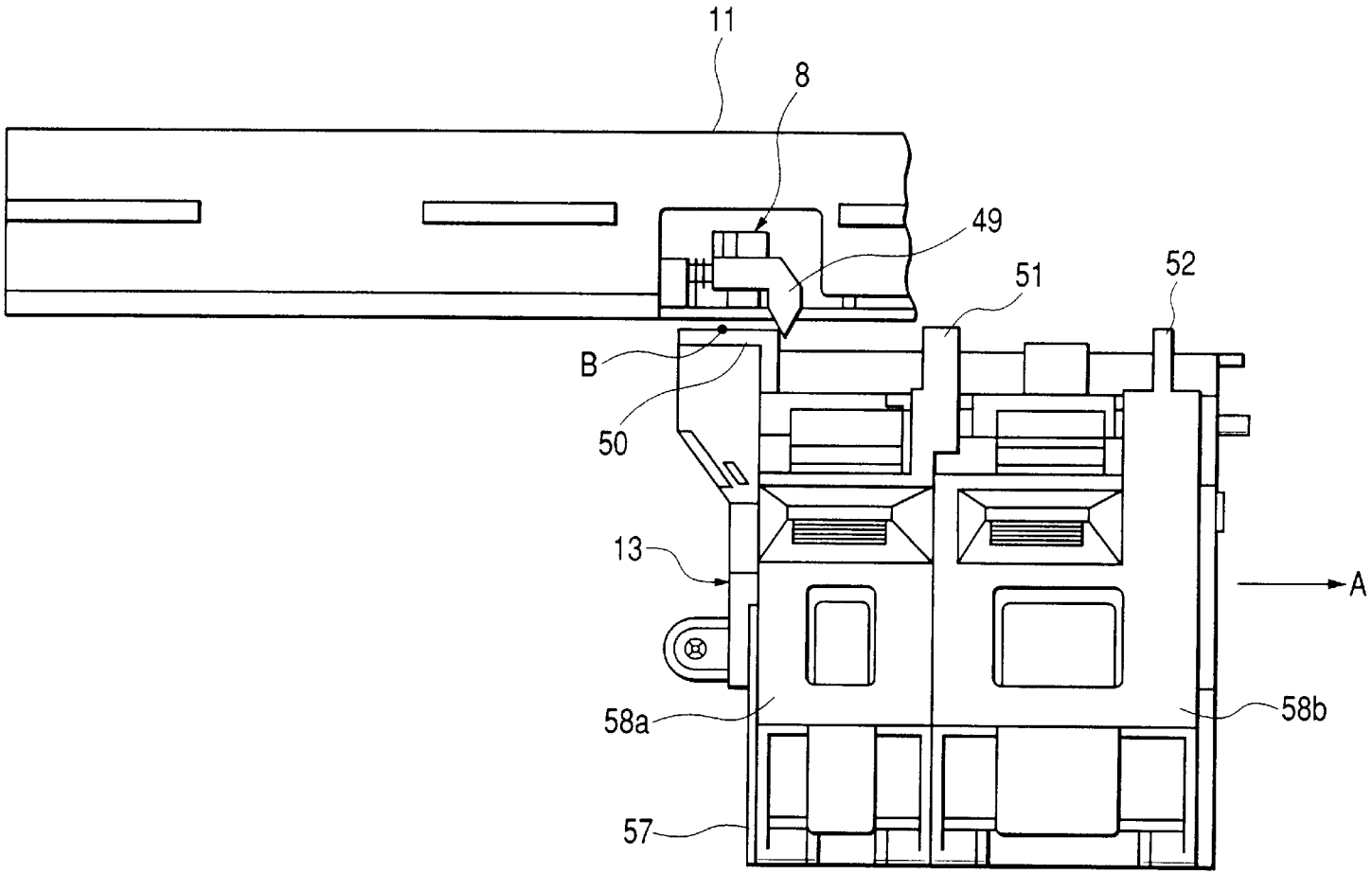
FIG. 13 is a schematic representation to show detection of an ink cartridge and detection of the standby position of a carriage.
Figure 14:
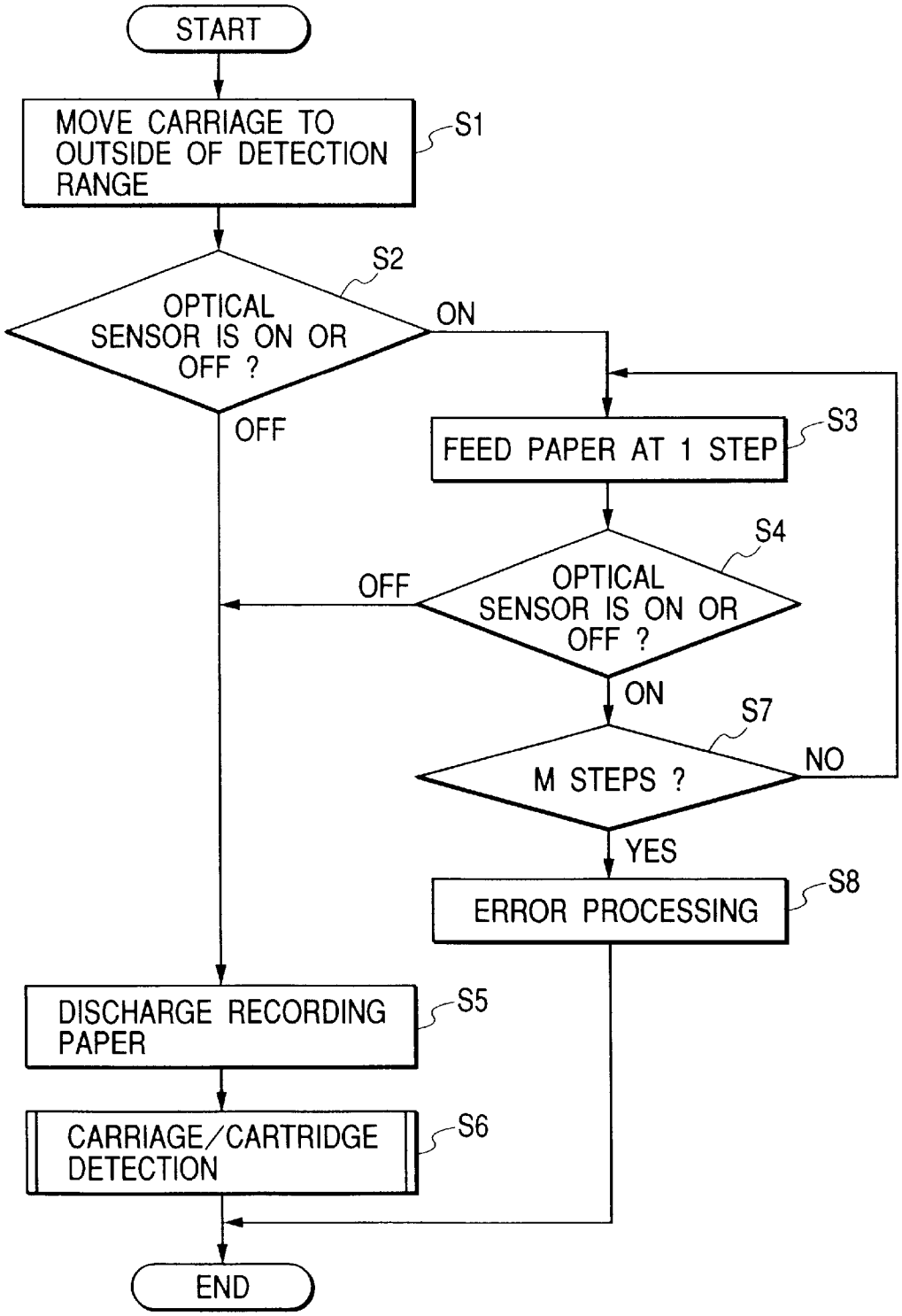
FIG. 14 is a flowchart to show a flow of general processing of detection of the ink cartridge and detection of the standby position of the carriage.
Figure 15:
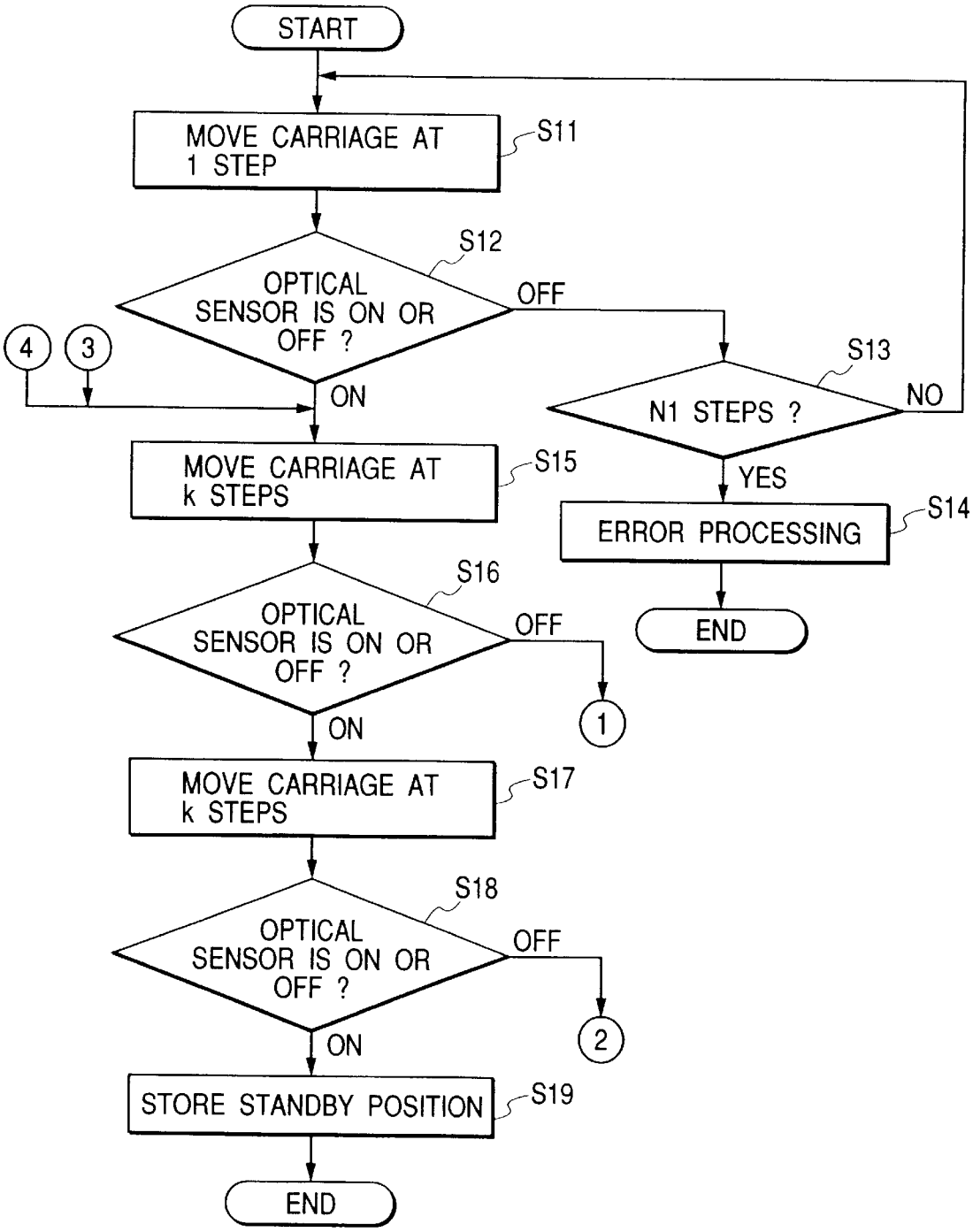
FIG. 15 is a flowchart to show a detailed flow of the carriage/ink cartridge detection processing.
Figure 16:
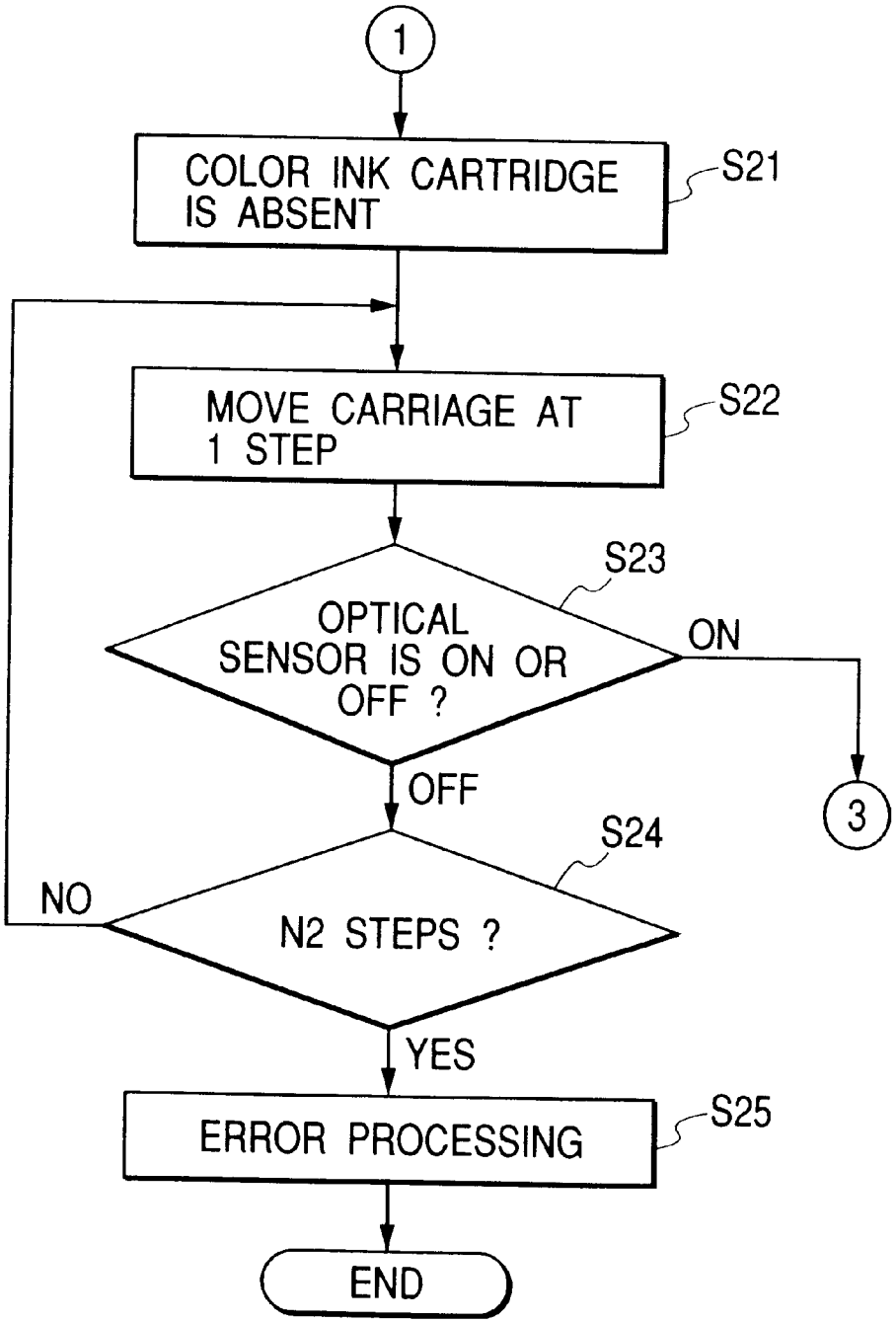
FIG. 16 is a flowchart to show a detailed flow of the carriage/ink cartridge detection processing.
Figure 17:
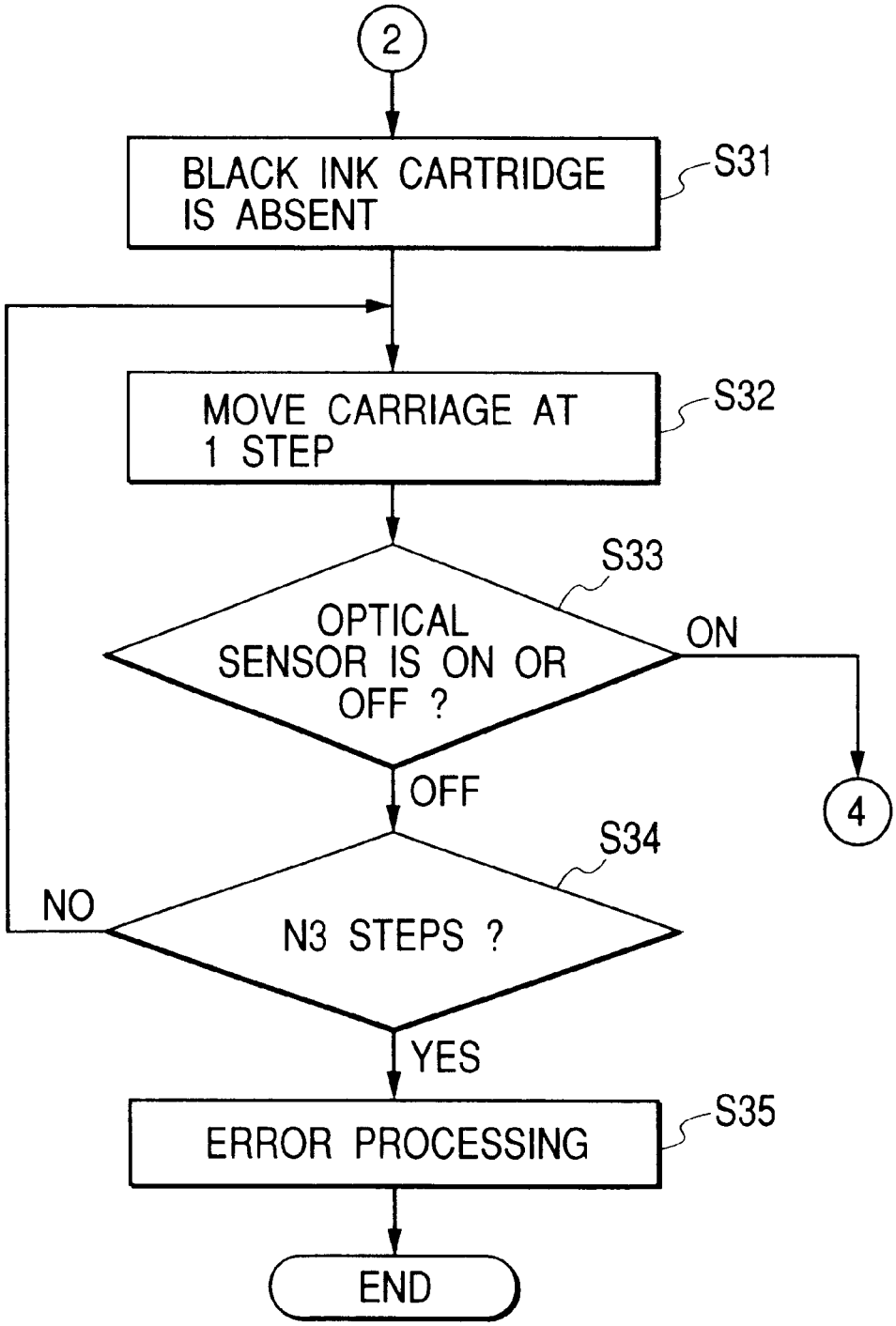
FIG. 17 is a flowchart to show a detailed flow of the carriage/ink cartridge detection processing.

Next, detection of the carriage 13 and the ink cartridge 14 will be discussed. FIGS. 10 to 13 are schematic representations to show detection of the ink cartridge 14 by the cartridge engagement parts 51 and 52 and the detector unit 8 and detection of the standby position of the carriage 13 by the carriage engagement part 50 and the detector unit 8. In FIG. 13, the standby position of the carriage 13 is the position where the carriage 13 further moves in the arrow A direction (right in FIG. 13) and the tip of the contact end part 49 arrives almost at the center of the carriage engagement part 50 indicated by letter B. FIG. 14 is a flowchart to show a flow of general processing of detection of the ink cartridge 14 and detection of the standby position of the carriage 13. FIGS. 15 to 17 are flowcharts to show a detailed flow of the carriage/cartridge detection processing shown in FIG. 14. The processing shown in the flowcharts of FIGS. 14 to 17 is executed by the controller 10.

After power of the printer 1 is turned on, the processing shown in the flowchart of FIG. 14 is executed before print starts. First, before the ink cartridge 14 and the standby position of the carriage 13 are detected, the carriage 13 is moved to the outside of the detection range of the detector unit 8 and is placed at a position shown in FIG. 10 by the controller 10 (step S1).

The term "the outside of the detection range of the detector unit 8" mentioned here refers to the state in which the second cartridge engagement part 52 is positioned at the left of the contact end part 49 in FIG. 10. To move the carriage 13 to the outside of the detection range of the detector unit 8, the carriage 13 is moved in an opposite direction to the arrow A (left). The move distance is a distance at which the carriage 13 is reliably placed outside the detection range of the detector unit 8 after it is moved even if the carriage 13 is at the standby position before it is moved, and the distance is previously stored in a memory unit (not shown) of the controller 10.

Subsequently, whether the optical sensor 16 is in ON or OFF state is determined (step S2). If the optical sensor 16 is in the ON state (ON at step S2), it means that the recording paper 2 is in contact with the paper detection member 12 (namely, the recording paper 2 remains in the printer 1). Thus, processing of discharging the recording paper 2 into the paper discharge section 5 is performed. That is, the paper transport roller 23 is forward rotated step by step at step S3 and whether the optical sensor 16 is in ON or OFF state is determined for each one-step rotation at step S4. The term "one step" mentioned here refers to the minimum rotation unit of the paper transport roller 23, for example, the rotation amount applied when one pulse signal is supplied to the paper feed motor 25.

When the recording paper 2 and the paper detection member 12 are brought out of contact with each other as the paper transport roller 23 is forward rotated, the optical sensor 16 changes to the OFF state (OFF at step S4). If the optical sensor 16 changes to the OFF state, the paper transport roller 23 is further rotated by a predetermined amount in the paper discharge direction for completely discharging the recording paper 2 into the outside from the paper discharge section 5 of the printer 1 at step S5. Then, processing of detection of the ink cartridge 14 and detection of the standby position of the carriage 13 is performed at step S6.

If the optical sensor 16 is in the OFF state at step S2 (OFF at step S2), the recording paper 2 is not in contact with the detector unit 8. However, the recording paper 2 may exist at a position out of contact with the detector unit 8 in the printer 1. Thus, also in this case, the paper transport roller 23 is forward rotated for discharging the recording paper 2 at step S5.

On the other hand, if the optical sensor 16 is in the ON state at step S2 and does not change to the OFF state although the paper transport roller 23 is forward rotated M steps (Yes at step S7), it is possible that an abnormal condition of a paper jam, etc., may occur. Thus, error handling is performed at step S8. The term "M steps" mentioned here refers to the number of steps (paper feed amount) for reliably making it possible to bring the recording paper 2 and the detector unit 8 out of contact with each other if the recording paper 2 is in contact with the detector unit 8 (paper detection member 12). The value of M is previously found and is stored in the memory unit of the controller 10.

The optical sensor 16 is thus placed in the OFF state by performing the position control of the carriage 13 (step S1) and discharge processing of the recording paper 2 (step S5)

before processing of detection of the ink cartridge 14 and detection of the standby position of the carriage 13 is performed.

The carriage/ink cartridge detection processing will be discussed in detail. In the processing, the carriage 13 is moved step by step by the controller 10 in the arrow A direction from the position shown in FIG. 10 (step S11 in FIG. 15). Whether the optical sensor 16 is in ON or OFF state is determined each time the carriage 13 is moved one step (step S12). Since the optical sensor 16 is preset to the OFF state as described above, if the optical sensor 16 changes from the OFF state to the ON state, it is possible that any of the second cartridge engagement part 52, the first cartridge engagement part 51, or the carriage engagement part 50 may come in contact with the contact end part 49.

On the other hand, if the optical sensor 16 is still held in the OFF state although the carriage 13 is advanced N1 steps, it is determined that some error occurs (Yes at step S13), and error handling is executed at step S14. The term "N1 steps" means the number of steps equal to or greater than the number of steps for the carriage 13 to return to the standby position from the position outside the detection range.

Here, assume that the color ink cartridge 14*b* is not mounted in the carriage main body 57. That is, assume that the second cartridge engagement part 52 is at the absence position and comes in contact with the contact end part 49 as shown in FIG. 11. In this case, the second cartridge engagement part 52 comes in contact with the contact end part 49, thereby pushing out the contact end part 49 backward (upward in FIG. 11). As a result, the carriage/cartridge detection member 15 is displaced to the second move position against the urging force of the spring 45 and the second shading plate 53 shades the optical axis of the optical sensor 16 (ON at step S12).

Subsequently, the carriage 13 is further advanced k steps in the arrow A direction at step S15. The term "k steps" refers to the number of steps corresponding to the distance slightly larger than the width of the second cartridge engagement part 52 in the main scanning direction and smaller than the width of the first cartridge engagement part 51 in the main scanning direction. Therefore, the width of the second cartridge engagement part 52 in the main scanning direction is set so as to become slightly smaller than the k-step move distance. k is an integer of one or more and is set to 10, for example.

Subsequently, whether the optical sensor 16 is in ON or OFF state is determined at step S16. Since the width of the second cartridge engagement part 52 in the main scanning direction is set slightly smaller than the k steps, the carriage 13 is moved k steps, whereby the second cartridge engagement part 52 and the contact end part 49 are brought out of contact with each other. Thus, the carriage/cartridge detection member 15 is restored to the second reference position by the urging force of the spring 45 and the optical sensor 16 is placed in the OFF state (OFF at step S16), whereby the controller 10 determines that the color ink cartridge 14*b* is not mounted (step S21 in FIG. 16).

Further, the carriage 13 is moved step by step at step S22 and whether the optical sensor 16 is in ON or OFF state is determined each time the carriage 13 is moved one step (step S23). At this time, if the optical sensor 16 changes from the OFF state to the ON state, it is possible that the first cartridge engagement part 51 or the carriage engagement part 50 may come in contact with the contact end part 49. On the other hand, if the optical sensor 16 is still held in the OFF state although the carriage 13 is advanced N2 steps, it is determined that some error occurs (Yes at step S24) and error handling is executed at step S25. The term "N2 steps" means the number of steps equal to or greater than the number of steps required for the carriage 13 to return to the standby position from the current position.

Here, assume that the black ink cartridge 14*a* is not mounted in the carriage main body 57. That is, assume that the first cartridge engagement part 51 is at the absence position and comes in contact with the contact end part 49 as shown in FIG. 12. In this case, the first cartridge engagement part 51 comes in contact with the contact end part 49, thereby pushing out the contact end part 49 backward (upward in FIG. 12). As a result, the carriage/cartridge detection member 15 is displaced to the second move position and the second shading plate 53 shades the optical axis (ON at step S23).

Subsequently, control returns to step S15 in FIG. 15 and the carriage 13 is further advanced k steps in the arrow A direction. Since the width of the first cartridge engagement part 51 in the main scanning direction is almost twice that of the second cartridge engagement part 52, the optical sensor 16 does not change to the OFF state as the carriage 13 is moved k steps (ON at step S16).

Then, the carriage 13 is further advanced k steps in the arrow A direction at step S17 and whether the optical sensor 16 is in ON or OFF state is determined. That is, the carriage 13 is advanced a total of 2 k steps (k steps at step S15 plus k steps at step S17). The width of the first cartridge engagement part 51 in the main scanning direction is set so that the first cartridge engagement part 51 can be brought out of contact as the carriage 13 is moved 2 k steps. Thus, the optical sensor 16 again changes to the OFF state (OFF at step S18). As a result, the controller 10 determines that the black ink cartridge 14*a* is not mounted at step S31 in FIG. 17.

Further, the carriage 13 is moved step by step at step S32 and whether the optical sensor 16 is in ON or OFF state is determined each time the carriage 13 is moved one step (step S33). At this time, if the optical sensor 16 changes from the OFF state to the ON state, it is possible that the carriage engagement part 50 may come in contact with the contact end part 49. On the other hand, if the optical sensor 16 is still held in the OFF state although the carriage 13 is advanced N3 steps, it is determined that some error occurs (Yes at step S34) and error handling is executed at step S35. The term "N3 steps" means the number of steps equal to or greater than the number of steps for the carriage 13 to return to the standby position from the current position.

If the optical sensor 16 changes to the ON state at step S33, it means that as shown in FIG. 13, the carriage engagement part 50 comes in contact with the contact end part 49 and pushes out the contact end part 49 backward (upward in FIG. 13) and consequently the carriage/cartridge detection member 15 is displaced to the second move position and the second shading plate 53 shades the optical axis. In this case, control returns to step S15 in FIG. 15 and the carriage 13 is advanced k steps. The width of the carriage engagement part 50 in the main scanning direction is set to twice or more that of the first cartridge engagement part 51. Therefore, the optical sensor 16 is in the ON state at step S16 and is still held in the ON state at step S18 after the carriage 13 is moved k steps at step S17.

If the optical sensor 16 is held in the ON state at step S18, the controller 10 determines the position of the carriage 13 to be the standby position and stores the position as the standby position at step S19. The standby position is used as the reference position of the carriage 13 in the later record operation.

On the other hand, if both the black ink cartridge 14*a* and the color ink cartridge 14*b* are mounted in the carriage 13, both the second cartridge engagement part 52 and the first cartridge engagement part 51 are at the presence position and thus do not come in contact with the contact end part 49. Therefore, in this case, the direct transition is made from the state shown in FIG. 10 to the state shown in FIG. 13. That is, in FIG. 15, the detection processing is started at step S11, then the optical sensor 16 is placed in the ON state at steps S16 and S18 and control goes to step S19. In this case, it is determined that both the ink cartridges 14*a* and 14*b* are mounted, and the standby position of the carriage 13 is stored.

If the color ink cartridge 14*b* is mounted and the black ink cartridge 14*a* is not mounted, the second cartridge engagement part 52 is at the presence position and the first cartridge engagement part 51 is at the absence position. Therefore, the second cartridge engagement part 52 does not come in contact with the contact end part 49 and the first cartridge engagement part 51 comes in contact with the contact end part 49. In this case, the direct transition is made from the state shown in FIG. 10 to the state shown in FIG. 12. That is, in FIG. 15, the detection processing is started at step S11, then the optical sensor 16 is placed in the ON state at step S16 and is placed in the OFF state at step S18. Consequently, control goes to step S31. In this case, it is determined that the color ink cartridge 14*b* is mounted and the black ink cartridge 14*a* is not mounted. In addition, the standby position of the carriage 13 is also stored.

In contrast, if the black ink cartridge 14*a* is mounted and the color ink cartridge 14*b* is not mounted, the first cartridge engagement part 51 is at the presence position and the second cartridge engagement part 52 is at the absence position. Therefore, the first cartridge engagement part 51 does not come in contact with the contact end part 49 and the second cartridge engagement part 52 comes in contact with the contact end part 49. In this case, the transition from the state shown in FIG. 10 to the state shown in FIG. 11 is made, then the transition to the state shown in FIG. 13 is made. That is, in FIG. 15, the detection processing is started at step S11, then the optical sensor 16 is once placed in the OFF state at step S16 and then is placed in the ON state at step S18 and control goes to step S19. In this case, it is determined that the black ink cartridge 14*a* is mounted and the color ink cartridge 14*b* is not mounted, and the standby position of the carriage 13 is stored.

The processing is performed while the carriage 13 is moved consecutively.

If it is determined that at least either of the ink cartridges 14*a* and 14*b* is not mounted, a message for prompting the user to place the ink cartridge 14*a*, 14*b* can be displayed on a display of the printer 1, a display of a host computer (not shown), etc. If an error occurs, it can also be displayed on the displays.

By the way, in the above-described embodiment, the carriage 13 mounts the two ink cartridges 14*a* and 14*b*, but the invention can also be applied to the carriage 13 of the type wherein one ink cartridge 14 is mounted; whether or not one ink cartridge 14 is mounted can be sensed. That is, in this case, the carriage 13 is provided with only one first cartridge engagement part 51 and the first cartridge engagement part 51 and the carriage engagement part 50 are used to sense whether or not the ink cartridge 14 is mounted and detect the standby position of the carriage 13.

The invention can also be applied to the carriage 13 of the type wherein three or more ink cartridges 14 are mounted; whether or not each of the three ink cartridges 14 is mounted can be sensed. That is, in this case, three or more cartridge engagement parts are provided in a one-to-one correspondence with the ink cartridges 14. The cartridge engagement parts are spaced from each other in the main scanning direction so that the optical sensor 16 can be switched between the ON state and the OFF state. The widths in the main scanning direction are made different so that the difference in the distance (namely, the time) to place the optical sensor 16 in the ON state can be detected.

Further, in the above-described embodiment, one detector unit 8 executes detection of the recording paper 2, detection of the standby position of the carriage 13, and detection of the presence or absence of the ink cartridge 14*a*, 14*b*, but can execute any desired two of the three detections, needless to say. That is, the cartridge engagement parts 51 and 52 are not provided, whereby the detector unit 8 executes detection of the recording paper 2 and detection of the standby position of the carriage 13. The carriage engagement part 50 is not provided, whereby the detector unit 8 executes detection of the recording paper 2 and detection of the ink cartridge 14. The paper detection member 12 is not provided, whereby the detector unit 8 executes detection of the standby position of the carriage 13 and detection of the ink cartridge 14.

Further, detection of only the presence or absence of the ink cartridge 14 can also be executed. That is, the paper detection member 12 and the carriage engagement part 50 are not provided, whereby the detector unit 8 executes only detection of the presence or absence of the ink cartridge 14. In this case, two or more ink cartridges 14 may exist and the presence or absence of each ink cartridge 14 can be detected, needless to say.

By the way, in the above-described embodiments, the engagement members of the carriage engagement part 50 and the cartridge engagement parts 51 and 52 are provided and the carriage 13 is moved in the main scanning direction, whereby the engagement members and the carriage/cartridge detection member 15 are brought into contact with each other and the shading part of the carriage/cartridge detection member 15 controls the operation of the optical sensor 16, but the invention is not limited to the configuration. For example, a carriage detection member and cartridge detection members may be placed on the side of a carriage 13 and be detected directly by a detector. A second embodiment adopting such a configuration will be discussed.

Figure 18B:
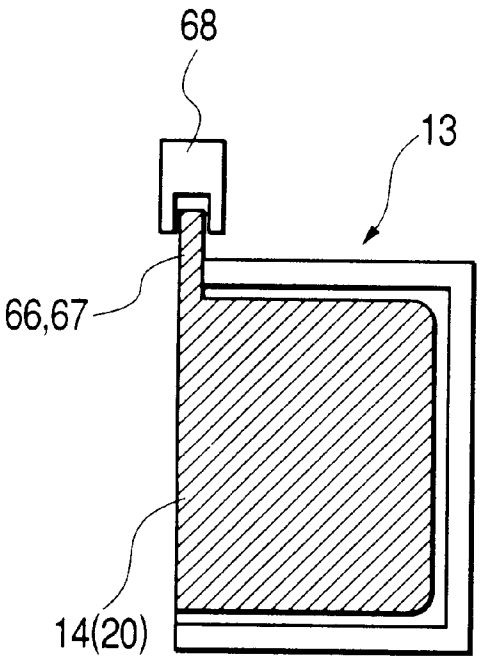
FIGS. 18A and 18B are drawings to describe a second embodiment wherein a carriage detection member and cartridge detection members are placed in a carriage.
Figure 18A:
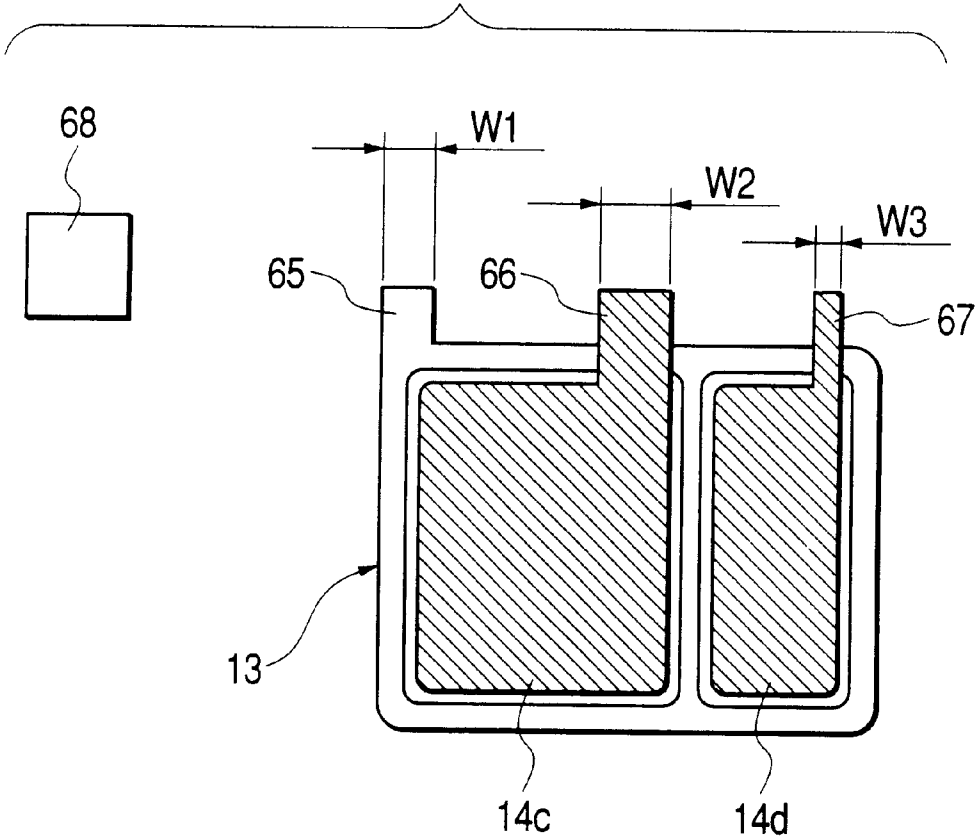

As shown in FIGS. 18A and 18B, a carriage detection member 65 is a plate-like piece having a shading property projected backward at the upper end on the driven pulley 28 side in a carriage 13 and the width of the carriage detection member 65 in the main scanning direction is determined a proper width W1. A first cartridge detection member 66 is a plate-like piece having a shading property placed on a color ink cartridge 14*c* and is projected backward at the upper end of the color ink cartridge 14*c*. The width of the first cartridge detection member 66 in the main scanning direction is determined a proper width of the cartridge 14*c*, W2. A second cartridge detection member 67 is a plate-like piece having a shading property placed on a black ink cartridge 14*d* and is projected backward at the upper end of the black ink cartridge 14*d*. The width of the second cartridge detection member 67 in the main scanning direction is also determined a proper width of the cartridge 14*d*, W3. In short, the three detection members 65, 66, and 67 are formed as different widths. The cartridge detection members 66 and 67 are set to different widths corresponding to the cartridge types.

An optical sensor 68 is a kind of detector of the invention and comprises a photo emitter and a photo detector facing each other with a gap between as in the above-described embodiment. When the carriage 13 is guided by a carriage guide shaft 22 and is moved, the carriage detection member 65 is placed so as to pass through the gap in the optical sensor 68. Therefore, when the carriage 13 passes through the front of the optical sensor 68, the carriage detection member 65 shades the optical axis of the optical sensor 68 only for the time corresponding to the width W1. The cartridge detection member 66, 67 is positioned at the same height as the carriage detection member 65 with attachment of the ink cartridge 14 (14*c*, 14*d*) in a cartridge holder section 20 and the projection amount from the rear end of the carriage 13 is also set to the same amount as the carriage detection member 65. In other words, the ink cartridge 14 is placed in the carriage 13, the cartridge detection member 66, 67 is positioned on the traveling path of the carriage detection member 65 at the main scanning time. Therefore, when the carriage 13 is moved in the main scanning direction, the cartridge detection members 66 and 67 trace the same path as the carriage detection member 65 and can be detected by the optical sensor 68.

Consequently, when the carriage 13 passes through the front of the optical sensor 68, the first cartridge detection member 66 shades light only for the time corresponding to the width W2 and the second cartridge detection member 67 shades light only for the time corresponding to the width W3. Thus, the cartridge detection members 66 and 67 are also detected by the optical sensor 68. The widths of the carriage detection member 65 and the cartridge detection members 66 and 67 in the main scanning direction are set to different proper widths and thus differ in the amount of time light is shaded in the optical sensor 68. Therefore, the detection members 65, 66, and 67 can be detected separately. In the embodiment, the carriage detection member 65 is positioned at the end part on the driven pulley 28 side in the carriage 13, the second cartridge detection member 67 is positioned at the end part on the drive pulley 27 side, and the first cartridge detection member 66 is positioned between the carriage detection member 65 and the second cartridge detection member 67.

The optical sensor 68 is disposed at a place corresponding to the standby position of the carriage 13. That is, when the carriage 13 is at the standby position, the carriage detection member 65 enters the gap and shades the optical axis. Therefore, the carriage 13 can be placed at the standby position by detecting the ON state of the optical sensor 68 (light shield state) with the carriage detection member 65.

Next, the operation of this embodiment will be discussed.

When the power of the printer 1 is turned on, first the necessary initialization operation is executed. In the initialization operation, the position recognition operation of the carriage 13 is performed. Then, the mount check operation of the ink cartridge 14 in the carriage 13 is performed.

In the position recognition operation of the carriage 13, first the carriage 13 is placed at a preparation position. That is, a controller 10 drives a carriage motor 26 for moving the carriage 13 to the driven pulley 28 side by a predetermined distance, for example, almost the same distance as the width of the carriage 13, whereby if the carriage 13 is at the standby position before the power is turned on, the second cartridge detection member 67 is positioned on the driven pulley 28 side from the optical sensor 68, namely, on the side away from the standby position.

If the carriage 13 is moved to the driven pulley 28 side, the carriage 13 is placed at a carriage detection position. That is, the controller 10 (carriage position controller) supplies pulses, thereby driving the carriage motor 26 for moving the carriage 13 toward the standby position at a constant speed. At the same time, the controller 10 monitors a detection signal from the optical sensor 68 and stops the operation of the carriage motor 26 provided that the carriage detection member 65 is detected (passes through). The carriage detection member 65, the first cartridge detection member 66, and the second cartridge detection member 67 are plate-like pieces having the proper width W1, the proper width W2, and the proper width W3 respectively as described above. Thus, if the carriage 13 is moved at the constant speed, the ON duration of the optical sensor 16 varies from one detection member passing through to another. Therefore, the controller 10 can identify the detection member 65, 66, or 67 passing through the optical sensor 68 based on a detection signal from the optical sensor 68.

If the carriage 13 is placed at the carriage detection position, whether or not the ink cartridge 14 is placed in the carriage 13 is determined. To do this, first the carriage 13 is placed at the first cartridge detection position, the detection position of the color ink cartridge 14*c*. That is, the controller 10 supplies a predetermined number of pulse signals corresponding to the distance between the carriage detection member 65 and the first cartridge detection member 66 to the carriage motor 26, thereby placing the carriage 13 at the carriage detection position at the first cartridge detection position. If positioning control of the carriage 13 is thus performed based on the number of pulses supplied to the carriage motor 26, the positioning control is simplified and the positioning accuracy is high.

If the carriage 13 is placed at the first cartridge detection position, whether or not the ink cartridge 14*c* is placed is determined. This determination is also made based on a detection signal from the optical sensor 68. If the detection signal from the optical sensor 68 is ON, it is determined that the ink cartridge 14*c* is placed. On the other hand, if the detection signal from the optical sensor 68 is OFF, it is determined that the ink cartridge 14*c* is not placed.

If whether or not the color ink cartridge 14*c* is placed has been determined, then whether or not the black ink cartridge 14*d* is placed in the carriage 13 is determined. This determination as to whether or not the black ink cartridge 14*d* is placed is also made in a similar manner to that of the determination as to whether or not the color ink cartridge 14*c* is placed. That is, first a predetermined number of pulse signals corresponding to the distance between the first cartridge detection member 66 and the second cartridge detection member 67 are supplied to the carriage motor 26 for moving the carriage 13 at the first cartridge detection position to the second cartridge detection position, the detection position of the black ink cartridge 14*d*. If the carriage 13 is placed at the second cartridge detection position, whether or not the ink cartridge 14*d* is placed is determined based on a detection signal from the optical sensor 68. That is, if the detection signal from the optical sensor 68 is ON, it is determined that the ink cartridge 14*d* is placed; if the detection signal is OFF, it is determined that the ink cartridge 14*d* is not placed.

If the initialization operation terminates and both the ink cartridges 14*c* and 14*d* are mounted, the carriage 13 is made to stand by at the standby position. Upon reception of print data within a predetermined time, the controller 10 starts scan control and moves the recording head 21 from the standby position to the record area. On the other hand, if at least either of the ink cartridges 14*c* and 14*d* is not placed, the controller 10 provides error information and places the carriage 13 at the preparation position (position in FIG. 1), for example, then prompts the user to place the ink cartridge 14*c* or 14*d* which is not placed.

Thus, in the embodiment, the recording head 21 is mounted on the carriage 13, two types of ink cartridges 14*c* and 14*d* are held detachably, the detection members 65, 66, and 67 detected by the optical sensor 68 are provided not only in the carriage 13, but also on the side of the ink cartridge 14, and the widths W1, W2, and W3 of the detection members 65, 66, and 67 are set to different proper widths. Thus, the carriage detection member 65 and the cartridge detection members 66 and 67 can be detected separately by the single optical sensor 68, and whether or not the ink cartridge 14*c*, 14*d* is placed can be determined based on the detection result.

Therefore, in the embodiment, the detector unit (optical sensor 68) for detecting the position of the carriage 13 can also be used for detecting the attachment state of the ink cartridge 14, so that the configuration of the detector unit 8 can be simplified and costs can be reduced.

In the embodiment, the detection members 65, 66, and 67 are formed of plate-like pieces having a shading property, but may be formed of shade-like or bar-like members having a shading property. In short, the detection members 65, 66, and 67 may be projection parts having a shading property. The detector is implemented as the optical sensor 16 and the detection members 65, 66, and 67 shade the optical axis of the optical sensor 16, but the invention is not limited to the combination. For example, the following combination may be adopted: The detection members 65, 66, and 67 are reflection markers and light reflected on the detection member is detected by the photo detector of the optical sensor 68. A configuration of using no light can also be adopted; a contact that can be electrically connected may be provided in the detector as a sensing mechanism and a contact member for controlling connection of the contact may be used as a detection member. Further, a sensing mechanism using a magnetic coupling and a detection member for shading it can also be used in combination.

By the way, in the above-described embodiment, the cartridge detection members 66 and 67 are formed integrally with the ink cartridges 14*c* and 14*d* respectively as an example, but the invention is not limited to the configuration. For example, a cartridge detection member may be formed integrally with a member for holding the ink cartridge 14 in the carriage main body. A third embodiment adopting such a configuration will be discussed.

Figure 19A:
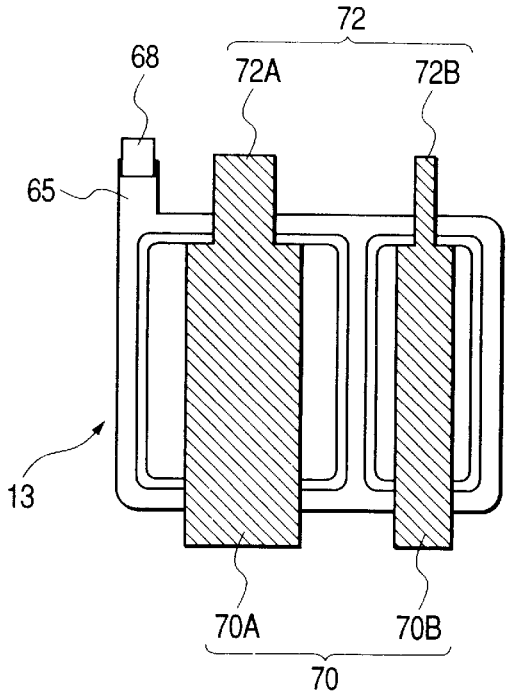
FIGS. 19A to 19C are drawings to describe a third embodiment wherein a carriage detection member and cartridge detection members are placed in a carriage.
Figure 19B:
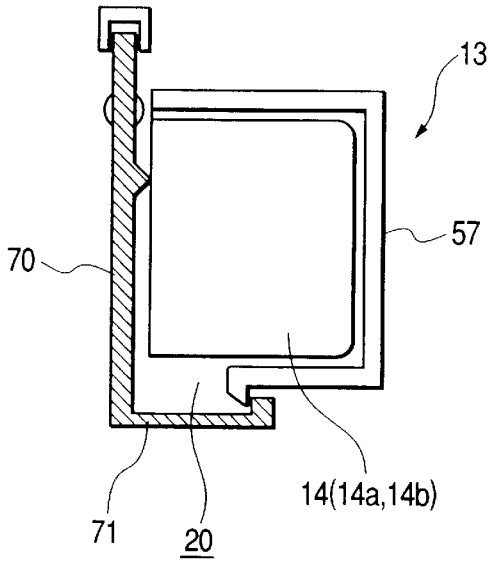

As shown in FIGS. 19A and 19B, a lid member 70 (70A, 70B) of a carriage 13 is a member provided by bending a plate roughly like L and is formed in the front end part with a hook part 71 for engaging an ink cartridge 14 and a cartridge detection member 72 (72A, 72B) is projected backward at the rear end part of the lid member. The cartridge detection members 72A and 72B are formed like the cartridge detection members 66 and 67 of the above-described embodiment. That is, the cartridge detection member 72A is a plate-like piece having a shading property placed in the lid member 70A for a color ink cartridge 14*b* and the width of the cartridge detection member 72A in the main scanning direction is set to a proper width, W2. The cartridge detection member 72B is a plate-like piece having a shading property placed in the lid member 70B for a black ink cartridge 14*a* and the width of the cartridge detection member 72B in the main scanning direction is set to a proper width, W3.

Figure 19C:
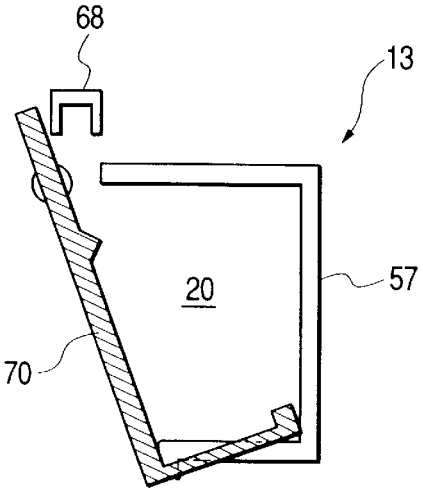

When the ink cartridge 14 (14*a*, 14*b*) is not placed, for example, at the ink cartridge replacement time, the rear end part of the corresponding lid member 70 (70A, 70B) is lifted up in a direction away from a cartridge holder section 20 with the engagement part at the front margin part of the carriage 13 as a fulcrum, as shown in FIG. 19C. In the no cartridge attachment state, the cartridge detection member 72 is moved to a position off the path of a carriage detection member 65. When the ink cartridge 14 is placed, the rear end part is retained in a carriage main body 57 and the ink cartridge 14 is held in the cartridge holder section 20 as shown in FIG. 19B. In the attachment state, a stopper placed on the lid member 70 abuts the ink cartridge 14 and thus the cartridge detection member 72 is positioned on the path of the carriage detection member 65.

Therefore, if the carriage 13 passes through the front of the optical sensor 68 in the state in which the ink cartridge 14 is placed, the carriage detection member 65 and the cartridge detection member 72 are detected by the optical sensor 68. On the other hand, if at least either of the ink cartridges 14*a* and 14*b* is not mounted, when the carriage 13 passes through the front of the optical sensor 68, the carriage detection member 65 is detected, but the cartridge detection member 72A or 72B corresponding to the ink cartridge 14*a* or 14*b* which is not placed does not pass through the detection area of the ink cartridge 14*a* or 14*b* (gap between photo emitter and photo detector) and thus is not detected.

If the lid member 70 is closed by mistake with the ink cartridge 14 not mounted, the stopper is not locked and thus the cartridge detection member 72 is placed off the path of the carriage detection member 65. Therefore, in the embodiment, a function similar to that in the above-described embodiment is also provided and the attachment state of the ink cartridge 14 can be detected by the optical sensor 68 that can detect the carriage detection member 65. Since the attachment state of the ink cartridge 14 can be thus detected by the sensing mechanism (detector) to detect the position of the carriage 13, the number of sensing mechanisms can be decreased. Consequently, the apparatus configuration can be simplified and is also advantageous for costs.

By the way, in the above-described embodiment, the widths of the detection members 65, 66, and 67 are made different, so that the detection members are detected separately, but the invention is not limited to the configuration. For example, the carriage detection member 65 and at least either of the cartridge detection members 66 and 67 may be formed with a light transmission section for allowing light from the photo emitter of the optical sensor 68 to pass through, and the detection pattern at the photo detector of the optical sensor 68 for the carriage detection member 65 may be made different from that for the cartridge detection member 66, 67. Further, the detection pattern for the cartridge detection member 66 corresponding to one cartridge type may be made different from that for the cartridge detection member 67 corresponding to another cartridge type.

Figure 20A:
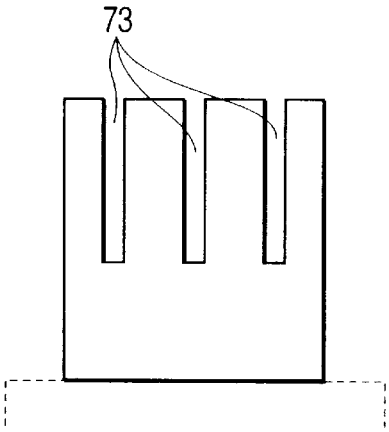
FIGS. 20A to 20F are drawings to describe embodiments wherein light transmission sections are provided for detection members.
Figure 20B:
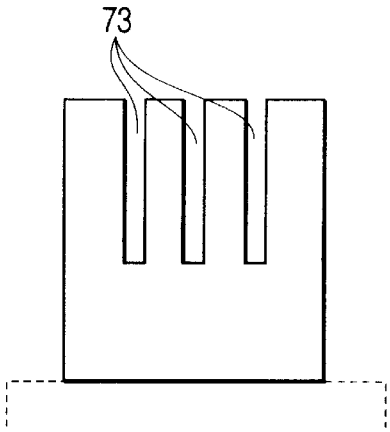
Figure 20C:
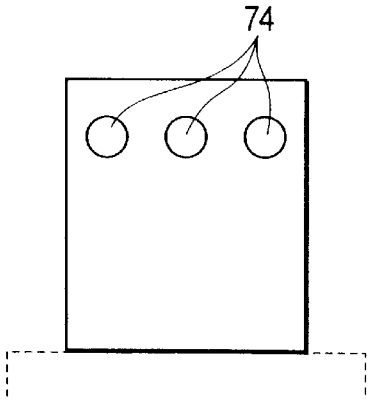
Figure 20D:
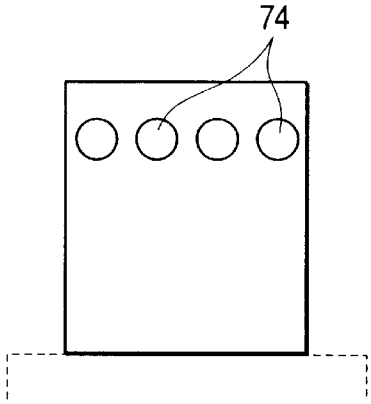
Figure 20E:
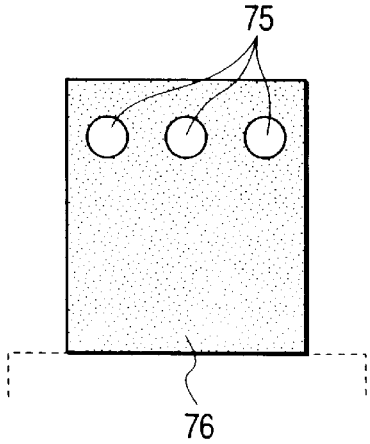
Figure 20F:
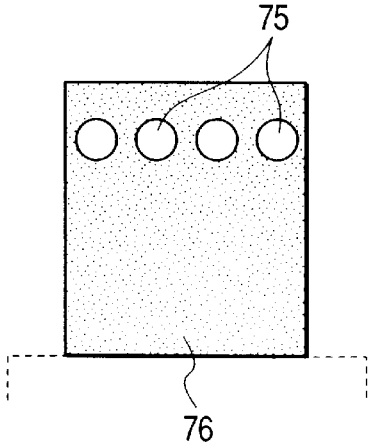

The light transmission section can be made up of a plurality of slits 73 formed side by side in the main scanning direction, for example, as shown in FIGS. 20A and 20B, a plurality of pin holes 74 formed side by side in the main scanning direction as shown in FIGS. 20C and 20D, or a plurality of light transmission window parts 75 formed side by side in the main scanning direction as shown in FIGS. 20E and 20F. The slits 73 and the pin holes 74 are formed by piercing the detection members 65, 66, and 67 formed of light shield material in the thickness direction. The light transmission window parts 75 are formed by putting a masking pattern 76 having a shading property on the surface of each detection member 65, 66, 67 formed of light transparent material.

To separately detect the detection members 65, 66, and 67 by the light transmission sections, the number of pin holes (light transmission window parts) of one light transmission section in the main scanning direction is made different from that of another light transmission section, as shown in FIGS. 20C to 20F. In doing so, when the detection members 65, 66, and 67 pass through the optical sensor 68, they differ in the number of pulse signals generated by the photo detector. Thus, the detection member passing through the optical sensor 68 can be identified based on the detection signal from the photo detector of the optical sensor 68. The spacing between the slits of one light transmission section in the main scanning direction is made different from that of another light transmission section, as shown in FIGS. 20A and 20B. That is, the scan speed of the carriage 13 when each detection member 65, 66, 67 is detected is constant and thus if the spacing between the slits of one light transmission section in the main scanning direction is made different from that of another light transmission section, the generation period of a pulse signal output from the photo detector of the optical sensor 68 varies depending on the detection member 65, 66, or 67. Thus, the detection member 65, 66, or 67 passing through the optical sensor 68 can be identified based on the detection signal from the photo detector.

The invention is not limited to the specific embodiments and various modifications can be made without departing from the spirit and the scope of the invention as claimed. For example, the recording head 21 mounted on the carriage 13 may be any type of recording head 21 if it jets ink drops. The print record medium printed by the printer 1 is not limited to the recording paper 2 and may be a sheet-like film, for example. Further, there may be adopted a configuration in which the cartridge detection member also serves as the carriage detection member.

What is claimed is:

1. A detector unit incorporated in a recording apparatus which comprises:

a carriage provided with a recording head and a cartridge holder in which an ink cartridge is detachably held;

a record section in which the carriage is reciprocately moved in a main scanning direction to record information onto recording paper; and a paper feeding section for feeding the recording paper into the record section, the detector unit comprising:

a paper detection member that detects the recording paper fed into the record section; and at least one of the following detection members:

a carriage detection member displaced by the main scanning movement of the carriage; and a cartridge detection member detectably displaced by the main scanning movement of the carriage when the ink cartridge is mounted in the cartridge holder; and a single detector for varying an output signal therefrom in accordance with at least one of the carriage and cartridge detection members and in accordance with the paper detection member to recognize the recording paper and at least one of the carriage, and the ink cartridge.

2. A detector unit incorporated in a recording apparatus which comprises:

a carriage provided with a recording head and a cartridge holder in which an ink cartridge is detachably held;

a record section in which the carriage is reciprocately moved in a main scanning direction to record information onto recording paper; and a paper feeding section for feeding the recording paper into the record section, the detector unit comprising:

at least two of the following detection members:

a carriage detection member displaced by the main scanning movement of the carriage;

a cartridge detection member detectably displaced by the main scanning movement of the carriage when the ink cartridge is mounted in the cartridge holder; and a paper detection member displaced by the recording paper fed into the record section; and a single detector for varying an output signal therefrom in accordance with the at least two detection members to recognize at least two of the carriage, the ink cartridge and the recording paper, wherein the paper detection member is placed on a transporting path of the recording paper in the record section so as to be movable between a first reference position and a first move position;

wherein the paper detection member is situated at the first reference position when the recording paper is not in contact therewith, and is situated at the first move position when the recording paper comes in contact therewith;

wherein a carriage engagement member is provided with the carriage;

wherein the carriage detection member is placed on a traveling path of the carriage engagement member so as to be movable between a second reference position and a second move position;

wherein the carriage detection member is situated at the second reference position when the carriage engagement member is not in contact therewith, and is situated at the second move position when the carriage engagement member comes in contact therewith;

wherein the detector detects at least one of the displacement of the paper detection member from the first reference position to the first move position and the displacement from the first move position to the first reference position; and wherein the detector also detects at least one of the displacement of the carriage detection member from the second reference position to the second move position and the displacement from the second move position to the second reference position.

3. The detector unit as set forth in claim 2, wherein the carriage engagement member comes in contact with the carriage detection member when the carriage is situated at a standby position thereof.

4. The detector unit as set forth in claim 2, wherein the detector includes a photo emitter and a photo detector;

wherein the photo detector receives the light emitted from the photo emitter when the paper detection member is situated at the first reference position and the carriage detection member is situated at the second reference position; and wherein the light emitted from the photo emitter is shaded when the paper detection member is situated at the first move position and the carriage detection member is situated at the second move position.

5. The detector unit as set forth in claim 4, wherein the paper detection member is pivotable between the first reference position and the first move position about a first fulcrum which defines a first move end and a second move end opposed to the first move end through the first fulcrum in between;

wherein the recording paper comes in contact with a first contact portion provided on the first move end of the paper detection member; and wherein the light emitted from the photo emitter is shaded by a first shading plate formed on the second move end of the paper detection member.

6. The detector unit as set forth in claim 4, wherein the carriage detection member is pivotable between the second reference position and the second move position about a second fulcrum which defines a first move end and a second move end opposed to the first move end through the second fulcrum in between;

wherein the carriage engagement member comes in contact with a second contact portion provided on the first move end of the carriage detection member; and wherein the light emitted from the photo emitter is shaded by a first shading plate formed on the second move end of the carriage detection member.

7. The detector unit as set forth in claim 2, wherein a cartridge engagement member is provided with the carriage so as to be movable between an absence position and a presence position;

wherein the cartridge engagement member is situated at the absence position when the ink cartridge is not mounted in the cartridge holder, and is situated at the presence position when the ink cartridge is mounted in the cartridge holder;

wherein the cartridge engagement member is arranged away from the carriage engagement member in the main scanning direction, and arranged such that either the absence position or the presence position is to be abutted against the carriage detection member in accordance with the main scanning movement of the carriage;

wherein respective widths of the carriage engagement member and the cartridge engagement member are made different from each other in the main scanning direction; and wherein the carriage detection member is situated at the second move position when the cartridge engagement member comes in contact with the carriage detection member.

8. The detector unit as set forth in claim 7, wherein a plurality of ink cartridges are mounted in the cartridge holder;

wherein a plurality of cartridge engagement members are provided in association with the plural ink cartridges;

wherein the plural cartridge engagement members are arranged away from each other in the main scanning direction, and arranged such that either the absence position or the presence position is to be subsequently abutted against the carriage detection member in accordance with the main scanning movement of the carriage;

wherein respective widths of the carriage engagement member and the cartridge engagement members are made different from each other in the main scanning direction; and wherein the carriage detection member is situated at the second move position when one of the cartridge engagement members comes in contact with the carriage detection member.

9. A detector unit incorporated in a recording apparatus which comprises:

a carriage provided with a recording head and a cartridge holder in which an ink cartridge is detachably held;

a record section in which the carriage is reciprocately moved in a main scanning direction to record information onto recording paper; and a paper feeding section for feeding the recording paper into the record section, the detector unit comprising:

at least two of the following detection members:

a carriage detection member displaced by the main scanning movement of the carriage;

a cartridge detection member detectably displaced by the main scanning movement of the carriage when the ink cartridge is mounted in the cartridge holder; and a paper detection member displaced by the recording paper fed into the record section; and a single detector for varying an output signal therefrom in accordance with the at least two detection members to recognize at least two of the carriage, the ink cartridge and the recording paper, wherein the paper detection member is placed on a transporting path of the recording paper in the record section so as to be movable between a first reference position and a first move position;

wherein the paper detection member is situated at the first reference position when the recording paper is not in contact therewith, and is situated at the first move position when the recording paper comes in contact therewith;

wherein a cartridge engagement member is provided with the carriage so as to be movable between an absence position and a presence position;

wherein the cartridge engagement member is situated at the absence position when the ink cartridge is not mounted in the cartridge holder, and is situated at the presence position when the ink cartridge is mounted in the cartridge holder;

wherein the cartridge detection member is placed on a traveling path of the cartridge engagement member so as to be movable between a second reference position and a second move position;

wherein the cartridge detection member is situated at the second reference position when the cartridge engagement member is not in contact therewith, and is situated at the second move position when the cartridge engagement member comes in contact therewith;

wherein the detector detects at least one of the displacement of the paper detection member from the first reference position to the first move position and the displacement from the first move position to the first reference position; and wherein the detector also detects at least one of the displacement of the cartridge detection member from the second reference position to the second move position and the displacement from the second move position to the second reference position.

10. The detector unit as set forth in claim 9, wherein a plurality of ink cartridges are mounted in the cartridge holder;

wherein a plurality of cartridge engagement members are provided in association with the plural ink cartridges;

wherein the plural cartridge engagement members are arranged away from each other in the main scanning direction, and arranged such that either the absence position or the presence position is to be subsequently abutted against the cartridge detection member in accordance with the main scanning movement of the carriage;

wherein the cartridge detection member is situated at the second move position when one of the cartridge engagement members comes in contact with the cartridge detection member; and wherein respective widths of the cartridge engagement members are made different from each other in the main scanning direction.

11. A detector unit incorporated in a recording apparatus which comprises:

a carriage provided with a recording head and a cartridge holder in which an ink cartridge is detachably held; and a record section in which the carriage is reciprocately moved in a main scanning direction to record information onto recording paper, the detector unit comprising:

a carriage engagement member displaced by the main scanning movement of the carriage;

a cartridge engagement member, provided with the carriage so as to be moveable between an absence position and a presence position;

a detector member placed on a travelling path of the carriage engagement member so as to be moveable between a first reference position and a first move position displace by the main scanning movement of the carriage;

a detector for varying an output signal therefrom in accordance with positions of the detection member;

wherein the cartridge engagement member is situated at the absence position when the ink cartridge is not mounted in the cartridge holder, and is situated at the presence position when the ink cartridge is mounted in the cartridge holder;

wherein the cartridge engagement member is arranged away from the carriage engagement member in the main scanning direction, and arranged such that the absence position is to be abutted against the carriage detection member in accordance with the main scanning movement of the carriage;

wherein respective widths of the carriage engagement member and the cartridge engagement member are made different from each other in the main scanning direction; wherein the detection member is moved from the first reference position to the first move position when at least one of the carriage engagement member and the cartridge engagement member comes in contact therewith; and wherein the detector detects the displacement of the detection member from the first reference position to the first move position.

12. The detector unit as set forth in claim 11, wherein the carriage engagement member comes in contact with the carriage detection member when the carriage is situated at a standby position thereof.

13. The detector unit as set forth in claim 11, wherein a plurality of ink cartridges are mounted in the cartridge holder;

wherein a plurality of cartridge engagement members are provided in association with the plural ink cartridges;

wherein the plural cartridge engagement members are arranged away from each other in the main scanning direction, and arranged such that either the absence position or the presence position is to be subsequently abutted against the carriage detection member in accordance with the main scanning movement of the carriage;

wherein respective widths of the carriage engagement member and the cartridge engagement members are made different from each other in the main scanning direction; and wherein the carriage detection member is situated at the first move position when one of the cartridge engagement members comes in contact with the carriage detection member.

14. A detector unit incorporated in a recording apparatus which comprises:

a carriage provided with a recording head, a cartridge holder in which an ink cartridge is detachably held and a lid member which covers the ink cartridge when the ink cartridge is mounted in the cartridge holder; and a record section in which the carriage is reciprocately moved in a main scanning direction to record information onto recording paper, wherein the detector unit comprises:

a carriage engagement member displaced by the main scanning movement of the carriage;

a detection member placed on a traveling path of the carriage engagement member so as to be movable between a first reference position and a first move position displaced by the main scanning movement of the carriage;

a cartridge engagement member disposed at the lid member and displaced by the main scanning movement of the carriage when the ink cartridge is mounted in the cartridge holder; and a detector for varying an output signal therefrom in accordance with positions of the detection member, wherein the cartridge engagement member is situated on a traveling path of the carriage engagement member only when the ink cartridge is not mounted in the cartridge holder; and wherein the detector is arranged within a region in which the carriage is movable in the main scanning direction to detect the carriage engagement member and the cartridge engagement member.

15. The detector unit as set forth in claim 14, wherein the detector includes a photo emitter and a photo detector for receiving light emitted from the photo emitter; and wherein the carriage engagement member and the cartridge engagement member are shading projections which are to be passed between the photo emitter and the photo detector.

16. The detector unit as set forth in claim 15, wherein respective widths of the carriage engagement member and the cartridge engagement member are made different from each other in the main scanning direction.

17. The detector unit as set forth in claim 16, wherein a plurality of ink cartridges are mounted in the cartridge holder and a plurality of lid members are provided with the carriage;

wherein a plurality of cartridge engagement members are provided in association with the plural ink cartridges and the plural lid members; and wherein respective widths of the cartridge engagement members are made different from each other in the main scanning direction.

18. The detector unit as set forth in claim 15, wherein a transparent part is formed on at least one of the carriage engagement member and the cartridge engagement member.

19. The detector unit as set forth in claim 18, wherein a plurality of ink cartridges are mounted in the cartridge holder and a plurality of lid members are provided with the carriage;

wherein a plurality of cartridge engagement members are provided in association with the plural ink cartridges and the plural lid members; and wherein a transparent part is formed on at least one of the cartridge engagement members.

20. An ink cartridge detection assembly incorporated in a recording apparatus which comprises:

a carriage reciprocally moved in a main scanning direction, and provided with a recording head, a carriage detection member and a cartridge holder in which an ink cartridge is detachably held;

a detector arranged within a region in which the carriage is movable in the main scan direction to detect the carriage detection member; and a cartridge detection member placed on the ink cartridge and situated on a traveling path of the carriage detection member to be detected by the detector;

wherein a plurality of ink cartridges are mounted in the cartridge holder;

wherein a plurality of cartridge detection members are provided in association with the plural ink cartridges; and wherein a transparent part indicative of a type ink cartridge installed in formed on at least one of the cartridge detection members.

21. The ink cartridge as set forth in claim 20, wherein the detector includes a photo emitter and a photo detector for receiving light emitted from the photo emitter; and wherein the cartridge detection member is a shading projection which is to be passed between the photo emitter and the photo detector.

22. The ink cartridge as set forth in claim 20, wherein a plurality of ink cartridges are mounted in the cartridge holder;

wherein a plurality of cartridge detection members are provided in association with the plural ink cartridges; and wherein respective widths of the cartridge detection members are made different from each other in the main scanning direction.

23. The ink cartridge as set forth in claim 20, wherein respective widths of the carriage detection member and the cartridge detection member are made different from each other.

24. The ink cartridge as set forth in claim 20, wherein the cartridge detection member also serves as the carriage detection member.

* * * * *